US010380845B2

(12) United States Patent
Platis et al.

(10) Patent No.: US 10,380,845 B2
(45) Date of Patent: Aug. 13, 2019

(54) PARI-MUTUEL EVENT WAGERING

(71) Applicant: Harry Platis, Mill Creek, WA (US)

(72) Inventors: Harry Platis, Mill Creek, WA (US); Kristopher Michael Shannon, Bothell, WA (US)

(73) Assignee: Harry B. Platis, Mill Creek, WA (US)

( * ) Notice: Subject to any disclaimer, the term of this patent is extended or adjusted under 35 U.S.C. 154(b) by 108 days.

(21) Appl. No.: 15/787,525

(22) Filed: Oct. 18, 2017

(65) Prior Publication Data

US 2018/0089946 A1 Mar. 29, 2018

Related U.S. Application Data

(63) Continuation of application No. 15/360,268, filed on Nov. 23, 2016, now abandoned, which is a continuation of application No. 14/853,843, filed on Sep. 14, 2015, now abandoned, which is a continuation-in-part of application No. 14/636,156, filed on Mar. 2, 2015, now abandoned, which is a continuation of application No. 14/568,089, filed on Dec. 11, 2014, now abandoned, which is a continuation of application No. 13/633,865, filed on Oct. 2, 2012, now abandoned, which is a continuation of application No. 12/472,344, filed on May 26, 2009, now Pat. No. 8,277,311, said application No. 15/360,268 is a continuation of application No. 14/853,843, filed on Sep. 14, 2015, now abandoned, (Continued)

(51) Int. Cl.
*G06F 19/00* (2018.01)
*G07F 17/32* (2006.01)

(52) U.S. Cl.
CPC ..... *G07F 17/3258* (2013.01); *G07F 17/3204* (2013.01); *G07F 17/3225* (2013.01); *G07F 17/3237* (2013.01); *G07F 17/3239* (2013.01); *G07F 17/3244* (2013.01)

(58) Field of Classification Search
None
See application file for complete search history.

(56) References Cited

U.S. PATENT DOCUMENTS 6,712,701 B1 * 3/2004 Boylan, III ..... G06Q 50/34 463/42
2001/0037293 A1 * 11/2001 Hindman ..... G06Q 10/00 705/39

(Continued)

*Primary Examiner* — Paul A D'Agostino
(74) *Attorney, Agent, or Firm* — Michael R. Schacht; Schacht Law Office, Inc.

(57) ABSTRACT

A system to coordinate a wagering event using a virtual Web server with an administration application and a server database. The administration application is executable code which can generate a first event page from an event category page. The administration application also has a player management page, a pool page and a ticket management set of pages. The administration application interoperates with a banking application and a casino application. The administration application will send the event information to the casino application, receive wager information from the casino application, coordinate wager amounts with the banking application, close the wagering, monitor the event, update pool, close the pool, and allocate the winnings and losses.

18 Claims, 25 Drawing Sheets

Related U.S. Application Data which is a continuation-in-part of application No. 13/948,978, filed on Jul. 23, 2013, now abandoned, which is a continuation of application No. 12/858,634, filed on Aug. 18, 2010, now Pat. No. 8,491,378.

(60) Provisional application No. 61/235,240, filed on Aug. 19, 2009, provisional application No. 62/409,664, filed on Oct. 18, 2016, provisional application No. 61/122,364, filed on Dec. 13, 2008.

(56) References Cited

U.S. PATENT DOCUMENTS

| | | | | |
|---|---|---|---|---|
| 2001/0047291 | A1* | 11/2001 | Garahi | G06Q 10/063 705/7.11 |
| 2002/0065566 | A1* | 5/2002 | Aronson | G07F 17/32 700/91 |
| 2004/0063484 | A1* | 4/2004 | Dreaper | G07F 17/32 463/16 |
| 2006/0258438 | A1* | 11/2006 | Platis | G07F 17/32 463/25 |
| 2007/0225069 | A1* | 9/2007 | Garahi | G06Q 50/34 463/25 |
| 2008/0274802 | A1* | 11/2008 | Joao | G07F 17/32 463/25 |
| 2010/0144426 | A1* | 6/2010 | Winner | G07F 17/32 463/25 |
| 2013/0073389 | A1* | 3/2013 | Heath | G06Q 50/01 705/14.54 |
| 2014/0274406 | A1* | 9/2014 | Walkingstick | G07F 17/3225 463/42 |

* cited by examiner

PARI-MUTUEL EVENT WAGERING

CROSS-REFERENCE TO RELATED APPLICATIONS

This application Ser. No. 15/787,525 claims priority of U.S. Provisional Patent Application Ser. No. 62/409,664 filed Oct. 18, 2016.

This application is also a continuation of U.S. patent application Ser. No. 15/360,268 filed Nov. 23, 2016, currently pending.

U.S. patent application Ser. No. 15/360,268 is a continuation of U.S. patent application Ser. No. 14/853,843 filed Sep. 14, 2015, now abandoned.

U.S. patent application Ser. No. 14/853,843 is a continuation-in-part of U.S. patent application Ser. No. 14/636,156 filed Mar. 2, 2015, now abandoned.

U.S. patent application Ser. No. 14/636,156 is a continuation of U.S. patent application Ser. No. 14/568,089 filed Dec. 11, 2014, now abandoned.

U.S. patent application Ser. No. 14/568,089 is a continuation of U.S. patent application Ser. No. 13/633,865 filed Oct. 2, 2012, now abandoned.

U.S. patent application Ser. No. 13/633,865 is a continuation of U.S. patent application Ser. No. 12/472,344 filed May 26, 2009 now U.S. Pat. No. 8,277,311, which issued on Oct. 2, 2012.

U.S. patent application Ser. No. 12/472,344 claims priority from U.S. Provisional Patent Application Ser. No. 61/122,364 filed Dec. 13, 2008, now expired, U.S. patent application Ser. No. 15/360,268 filed Nov. 23, 2016 is also a continuation of U.S. patent application Ser. No. 14/853,843 filed Sep. 14, 2015, now abandoned.

U.S. patent application Ser. No. 14/853,843 is a continuation-in-part of U.S. patent application Ser. No. 13/948,978 filed Jul. 23, 2013, now abandoned.

U.S. patent application Ser. No. 13/948,978 is a continuation of U.S. patent application Ser. No. 12/858,634 filed Aug. 18, 2010, now U.S. Pat. No. 8,491,378, which issued on Jul. 23, 2013.

U.S. patent application Ser. No. 12/858,634 claims priority from U.S. Provisional Patent Application Ser. No. 61/235,240 filed Aug. 19, 2009, now expired.

The contents of all related applications are incorporated herein by reference in their entireties.

INCORPORATION BY REFERENCE

U.S. patent application Ser. No. 11/215,633 filed Aug. 29, 2005, now abandoned, is hereby incorporated by reference in its entirety.

BACKGROUND

Totalisator Systems consist of networks of computers and wagering terminals linked by modems and frame relay systems which electronically combined wagers into "pools." Based on pool totals, the system records and displays changes in betting patterns and recalculates parimutuel odds and projected payoffs in timed intervals. Odds are established based on the proportion of money wagered into the pool on each horse. Odds change throughout the course of the wagering cycle and only become final when the wagering pool was closed at the start of the race. When the race results of a race are official, the system calculates payoffs on all winning wagers and betters can collect winnings. Present state-of-the-art systems operate on the intertote system protocol (ITSP), which is adapted from its original use in inter-track, intratote wagering on live races at individual facilities to support extensive inter-track, interstate, and intertote wagering on simulcasts (such as closed-circuit televisions).

The present intertote system protocol has two main functions: translation of wagering data into uniform computer language and data transportation. It supports a summation of bets or wagers per wagering combination on a per-pool, per-race basis and enables post event analysis of wagering data. When the system is in a non-wagering mode, for data to be examined the records must be retrieved manually from backup tapes. The system as present does not enable the transfer of wagers themselves to the host site or the combination of actual data across systems, which if it were provided, would aid in the real-time detection of wagering irregularities.

ITSP transmits wagering data serially, so that each bit of electronic data must remain in precise order throughout the transfer process in order for the data to be retrieved successfully. If transmission interruptions occur or data is lost, manual procedures must be implemented to merge wagering information back into the data stream.

The ITSP system functions on bandwidth that sustains data transmission speeds ranging from 2.4 Kb per second to 19.2 Kb per second. Delays are observed in posting of final odds, the amount of time it takes for the system totes to collect, process, and merge data from hundreds of sources into the host betting pools and trigger a new round of parimutuel odds which delay is largely a function of the ITSP limited bandwidth.

With regard to security controls for the parimutuel wagering system, the primary control of security exists at the level of the Totalisator company. Generally, each company provides proprietary security programs, policies, response procedures and managerial controls to respond to security incidents. The policies are not uniform across all companies. Generally, contracts for tote services and for simulcasting provide cross-company security standards.

With regard to regulatory control, parimutuel wagering largely takes place at the state level. Racing commissions are the licensing entities for horseracing and are statutorily authorized to enforce the rules of parimutuel racing and wagering. Regulations vary between jurisdictions as to levels of regulatory control. To create additional symmetry between the state regulatory associations, a joint model rules of racing developed by the NAPRA and RCI are proposed to incorporate enhanced guidelines for wagering security.

With regard to verifying and reviewing tickets and determining if they are either winning or fraudulent verification can be difficult. In some cases paperless wagers are made at remote locations, within or outside the United States, so that verification of the wagering specifics (for example via audio or digital tapes) involves the cooperation of multiple parties (for example host track, the tote company, a US wagering hub, the hubs tote company, and the off-track betting facility or wagering account service and it's tote company). In some cases, the data tapes must be pulled and reviewed by relevant staff for each wagering event to verify the ticket. See the August 2003 report on "Improving Security in the United States Parimutuel Wagering System: Status Report and Recommendations" presented by the NTRA wagering technology working group in conjunction with Giuliani partners LLC.

DESCRIPTION OF THE PREFERRED EMBODIMENTS

Wagering Web Service System and Method

Figure 1:
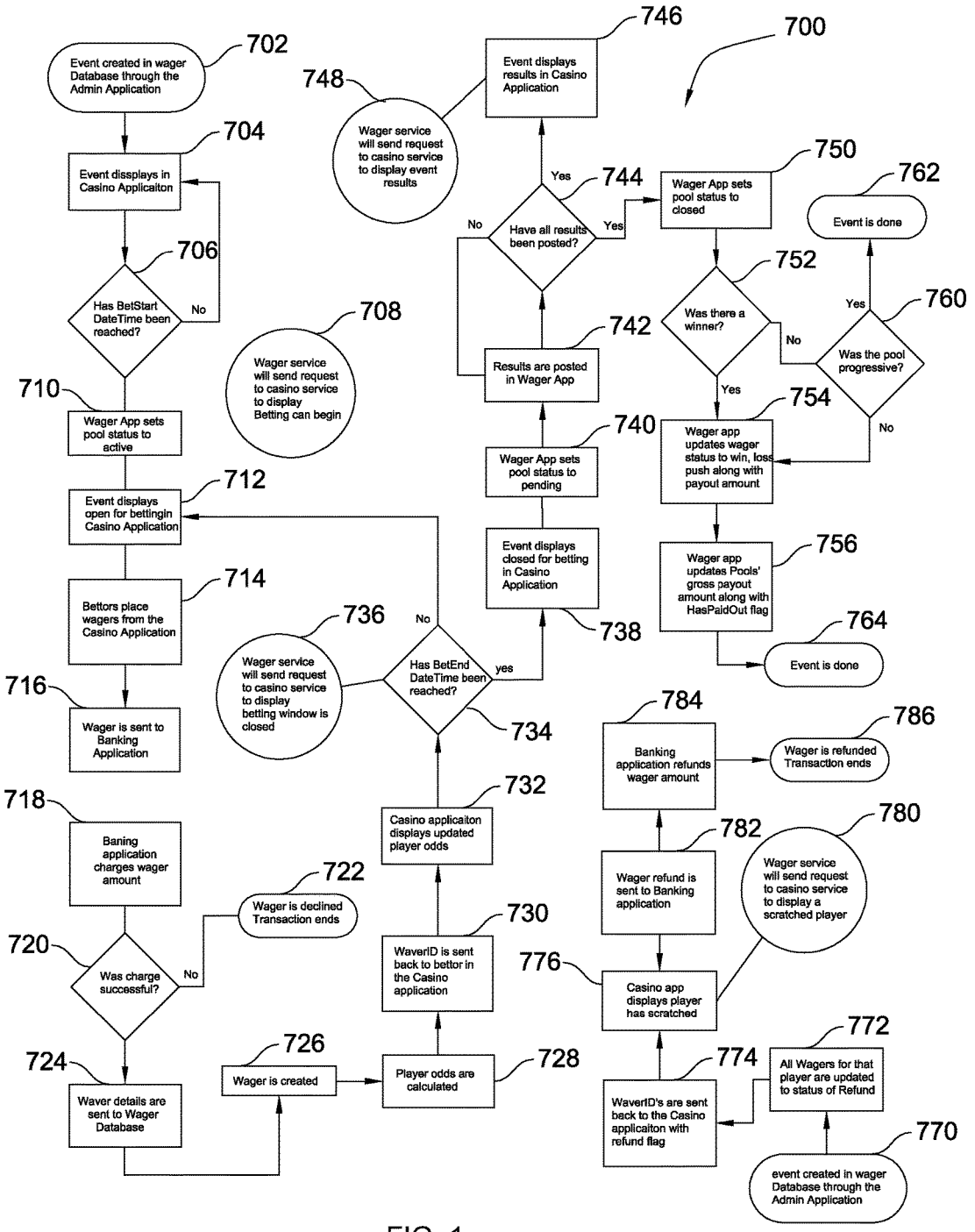
FIG. 1 is a flowchart of the wagering web service.

In one example, the present embodiment provides a wagering web service which operates on a wagering web virtual server and coordinates wagering on events such as tournaments, wagering on entrants in such events, wagering event-location applications and databases (such as casino applications and their related databases), financial institutions (such as bank applications and databases), and the individual wagering events themselves (such as various types of wagering scenarios, for example a win bet, a choose n to win, (wagering on large entrant groups) etc.)

The wagering web service acts to synthesize and coordinate the disparate applications to create a Virtual Totalsator System. This Virtual Totalsator System utilizes a scalable technology platform and encrypted communication channels to provide a secure Web service. The service utilizes in one embodiment a Web Service Definition Language or WSDL. The Web service method interfaces and interacts with the various databases discussed above utilizing a Simple Object Access Protocol or SOAP to exchange the structured information regarding the transactions. The protocol utilizes XML as its message format.

The bandwidth limitations are only limited to the local portals within which the end transactions are taking place. With regard to security controls, the primary control of security exists at the wagering Web service administration application location, and shares security with each of the locations, for example at the event locations, financial locations, and at the wagering locations. Therefore, security is shared disparately between each location and provides a separation of information. With regard to regulatory control, the pari-mutuel wagering takes place at the local level, and the wagering web service administration can take place off-site because no wagering is taking place there.

With regard to verification of tickets and IDs, the system uses a GUID regime which provides for near unique ticket ID generation. While each generated GUID is not guaranteed to be unique, the total number of unique keys 2 to the 128th or 3.4×10 to the power 30, is so large that the probability of the same number being generated twice is extremely small.

A more detailed discussion of the present system will now be provided. The present system provides a scalable technology platform, which enables the development of a centralized database of wagering information, as well as provides an encrypted communication channel for interaction with a secure web service which utilizes WSDL for the web service method interface and interaction with the database via SOAP. Furthermore, the client/system authentication uses public-key encryption where authorized systems, kiosks or websites can communicate with the web service. Additional data integrity includes the use of advanced data validation to ensure the integrity of the data through the lifecycle of the system and a transactional database enables every action taken against the database be rolled up into a transaction where it can then be rolled back for prevention of data loss as well as review of actions which occur during the wagering processes.

With regard to encryption, all communications are provided with internal systems encrypted via RSA 128 bit public-key encryption which prevents the cashing of unclaimed winning tickets. Each ticket ID is based on a unique ticket identification and is generated as a GUID where the GUID is a 16 byte 128 bit random identifier. The GUID or globally unique identifier is a special type of identifier used in software applications in order to provide a reference number which is unique in any context. For example, in defining the internal reference of a type of access point in the software application, or for creating unique keys in the database, the GUID provides a unique reference number for these purposes. While each generated GUID is not guaranteed to be unique, the total number of unique keys 2 to the 128th or 3.4×10 to the power 30, is so large that the probability of the same number being generated twice is extremely small. As an example, consider the observable universe, which contains about five to the 10 power 22 stars; every star could then have 6.8×10 to the 15 universally unique GUIDs. The term GUID generally refers to Microsoft's implementation of the universally unique identifier or (UUID) standard. Many systems use the term GUID, including Oracle Database, my SQL, DBase, OpenView Operations, ISIS Papyrus, and Novell E Directory. The GUID is also the basis for the GUID partition table, Intel's replacement for master boot records under EFI.

In addition, the present system provides clear authentication of each request which is sent to the web service in order to successfully pass data from one component of the system to another component of the system, for example coordinating the data request from a bank client location to a casino client location.

Generally speaking, the present system integrates client applications and provides a modular and extensible architecture. The client applications do not communicate with the database directly and are transacted through the intermediate web service thus providing the modularity required for creating the scalable platform. In addition, web services utilize open architecture which allows for any system, device, or websites to interact with the web service as long as it has the ability to communicate with the web service via XML and/or SOAP thus providing the extensibility required for enabling the system within different environments.

The present system can be ported to various use scenarios as previously discussed in the parent applications. For example, the World Series of Poker or any event can be offered through x-named players and one or multiple field bets. Additionally, the final table pick with an (n) order of finish can be chosen. A March Madness/NCAA Basketball tournament can be provided utilizing a final 2, final 4, or elite 8 pools or the entire 64 tournament team pool. Mobile wagering within land-based casino operations utilizing a handheld device or smart phone, as well as networking multiple land-based casinos into large "jumbo" wagering pools.

The present system also provides additional flexibility over the traditional totalisator systems. This includes event independent feature, configurable wagering pools, and the ability to pick "n" number of entrants within the event to place or win in any particular order. For example, as previously discussed in U.S. patent application Ser. No. 11/215,633 filed Aug. 29, 2005, the event independent features include a system where any event types such as poker, billiards, tennis, golf, basketball with multiple entrants or large number of entrants within the fields can be wagered upon. The configurable betting pools offer features such as commissions, minimum and maximum wager amounts, mandatory payouts, progressive or win/lose pools, maximum number of wagers, all defining various winning criteria from a win bet to pick (n).

Figure 2:
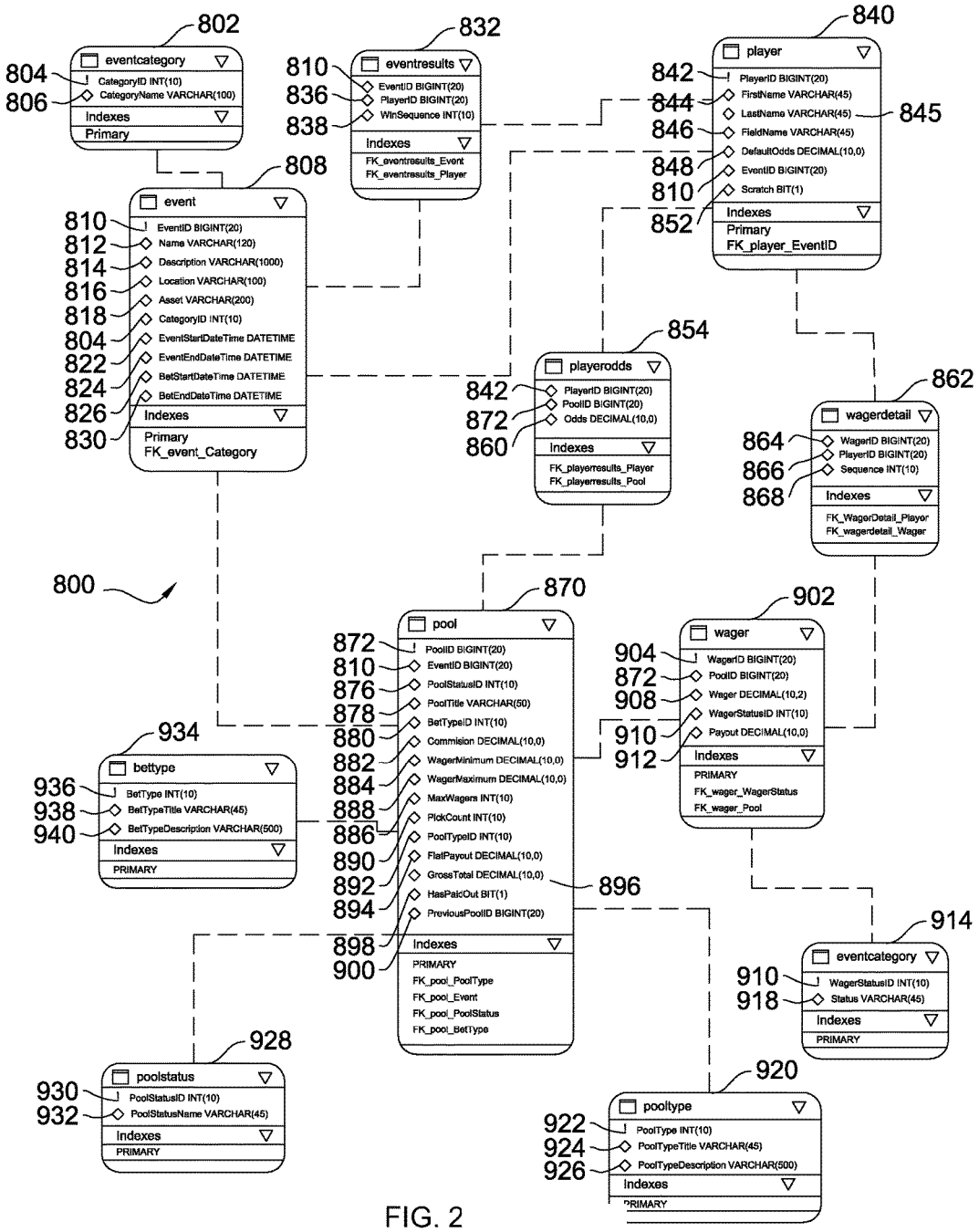
FIG. 2 as a schematic detail of the database.
Figure 5:
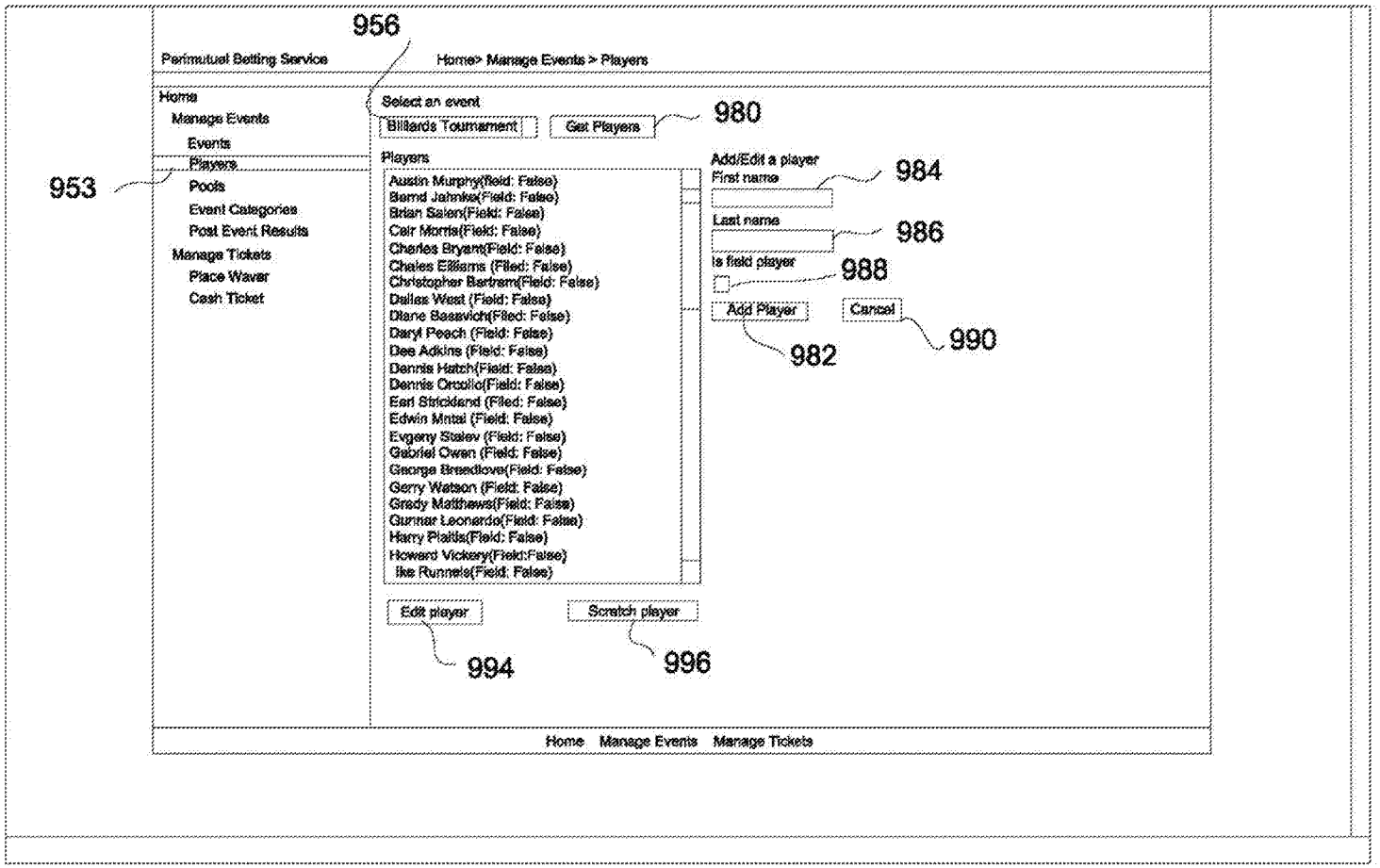
FIG. 5 is a plan view of the players page.

This is in alternative embodiment to the wagering application 42 as seen in FIG. 5 of U.S. patent application Ser. No. 11/215,633 filed Aug. 29, 2005. The main focus of this particular embodiment is in providing the wagering backend application 84 to coordinate the parimutuel wagering events between the various parties. Additionally, get information and add information events are posted and returned for coordination of the casino applications 34 the banking applications 38 and the clients 12 as seen in FIGS. 1 and 2 of U.S. patent application Ser. No. 11/215,633 filed Aug. 29, 2005.

Figure 20:
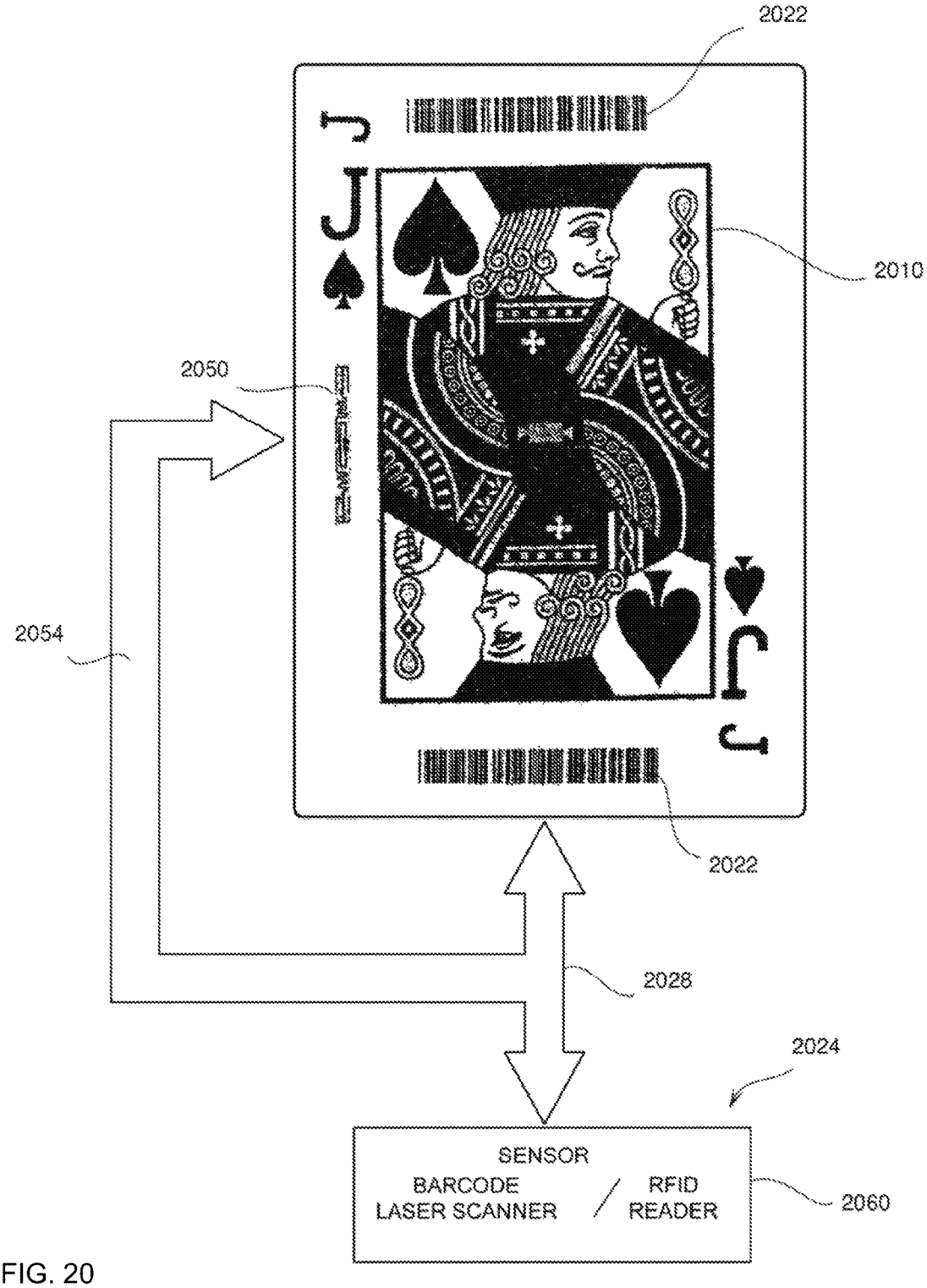
FIG. 20 is a plan view of an alternative embodiment of the interactive playing card.

The wagering web service method 700 as seen in FIG. 1 utilizes in this particular embodiment XML requests and responses. This wagering web service method 700 operates on the wagering web service database 800 as seen in FIG. 20 which utilizes a relational database and a transactional database such as MySQL server and as previously discussed interacts with the database via SOAP and includes WSDL method definitions for interface with the database.

Figure 3:
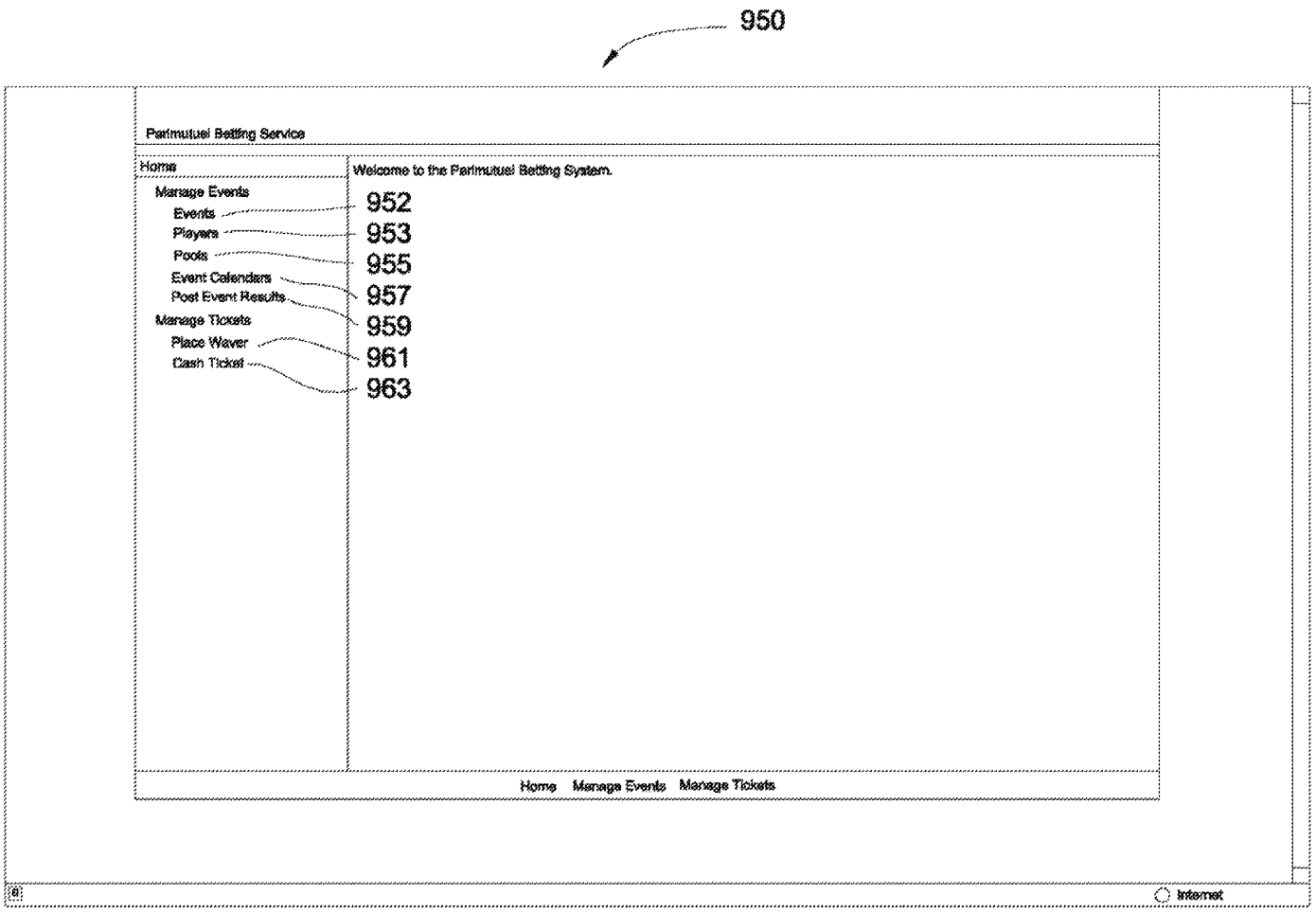
FIG. 3 is a plan view of the wagering web service home page.

A discussion of the wagering web service method 700 will be provided followed by a detailed discussion of the database 800 and then an implementation will be discussed in FIGS. 3 through 10 of the wagering web service 950 as seen in FIG. 3 implementing the web service wagering application.

Referring to FIG. 1, the wagering web service method 700 utilizes a number of steps which can be broken into discrete parts but which will be talked in total here in the present embodiment. Before the wagering web service can host an event, the user must create an event in the wager database through the wagering web service system application 950 at step 702. Once the event is created the event is displayed in the casino application 34 (see FIG. 2 of U.S. patent application Ser. No. 11/215,633) at step 704. The system then checks to see if a bet start date and time has been reached at step 706. In order to determine this, the wagering service will send a request to the casino application or service 34 to display whether or not betting can begin at step 708. If the bet's start date and time has not been reached, the event continues be displayed in the casino application 704. If it has been reached, then the wagering application or wagering service 950 and/or wagering application 42 in FIG. 5 of U.S. patent application Ser. No. 11/215,633, will set the pool to active status at step 710.

With the pool set to active status, the event is displayed as being open for betting in the casino application at step 712. During this time, individuals at the casino application or in a location where individuals can wager legally, can place a wager from the casino application client computer at step 714. The wager is sent to the banking application at step 716 and the wagering service requests from the either banking application or the casino application if the charge was successful at step 720. If not, the wager is declined and the transaction ends at step 722. If the charge was successful than the wager details are sent to the wagering database 800 or wagering database 40 (see FIG. 5 of U.S. patent application Ser. No. 11/215,633) at step 724. The wager is created at step 726 in the wagering web service system 950 or in other words the wagering application 42 (see FIG. 5 of U.S. patent application Ser. No. 11/215,633). Once the wager is created, player odds are calculated at step 728.

Figure 6:
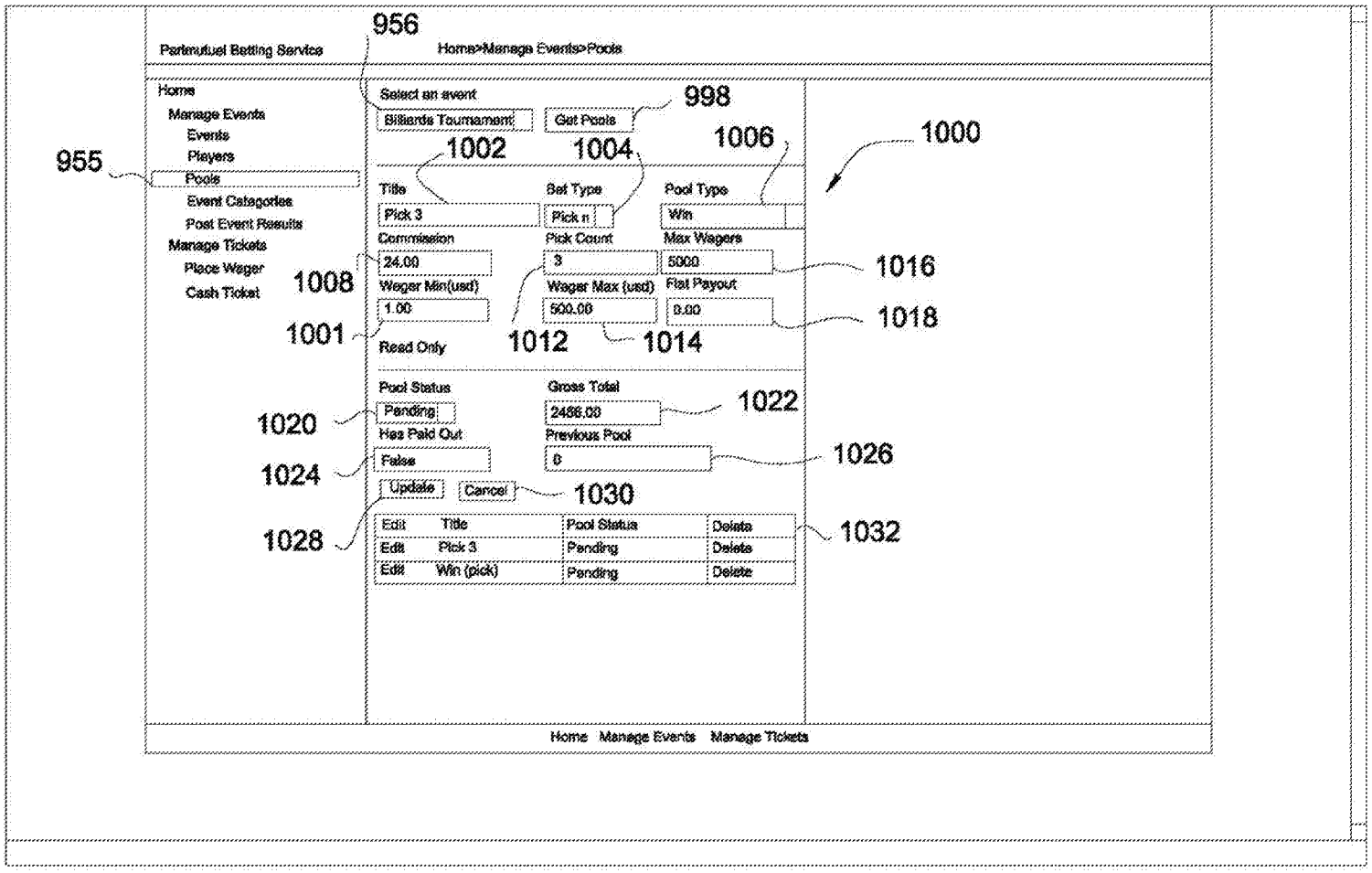
FIG. 6 is a plan view of the polls page.
Figure 10:
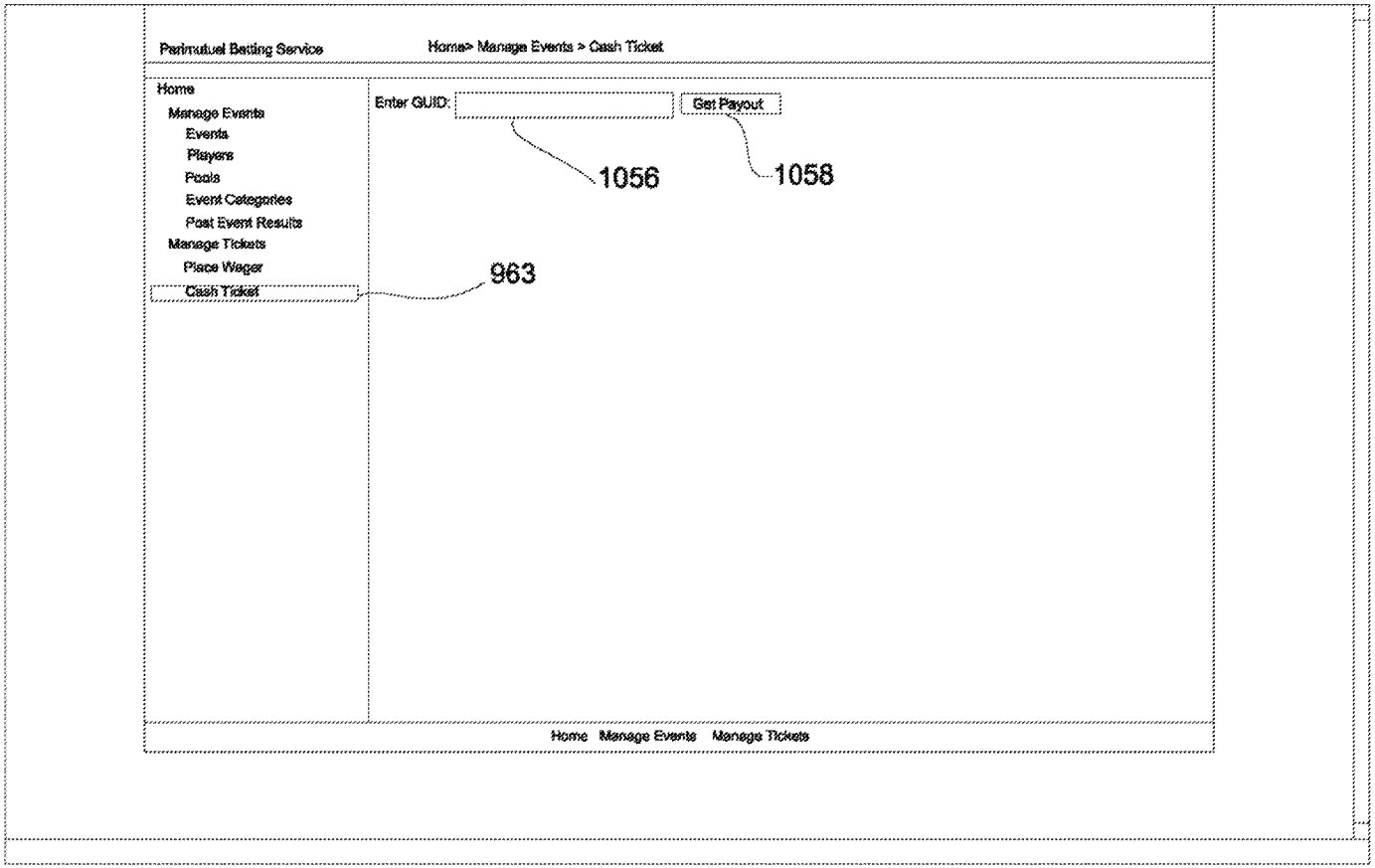
FIG. 10 is a plan view of the ticket page.

One way of calculating player odds at step 728 steps is to use the previously discussed method of calculating odds for large pools in parimutuel wagering on a large number of entrants as seen in FIG. 11A of U.S. patent application Ser. No. 11/215,633 where the set bet types 98 or bet set that pools 110 as seen in FIG. 6 of U.S. patent application Ser. No. 11/215,633 or later on discussed below as web methods for calculating player odds in the player odds web method 854 as seen in FIG. 3. The wager is created and a wager ID which is a GUID ID 1056 as seen in FIG. 10 is sent back to the bettor in the casino application at step 730 and a ticket is generated either electronically or by paper utilizing a relational or the actual GUID ID so that the individual wagering has a ticket in hand to present to the ticket office when redeeming his or her winnings. This is a unique ticket that is only generated once. It is generated either through standard printing means, or maybe generated electronically and provided to the individuals cell phone or PDA or client laptop computer or desktop computer.

The web service then returns to the casino application the updated player odds which the casino application displays at step 732. The casino application continues to poll the web service to determine if the bet end date and time have been reached at step 734. This occurs when at step 736 the wager service sends a request to the casino application to display the betting window has been closed. When the event being displayed is closed for betting or wagering in the casino application at step 738, then the web service sets the pool status to pending at step 740. This is when the wagering stops and the play begins within the particular event such as the poker tournament as previously mentioned in the parent application or billiards tournament etc.

The results are then posted in the web service application at step 742 and once all results have been posted at step 744 the web service sends the casino application the event results at step 746. The wagering web service will send a request to the casino service to display the event results at step 748.

Then the wagering application or web service sets the pool status to close at step 750 and the web service determines if there was a winner at step 752. If there was no winner, the web service determines if the pool was a progressive pool at step 760. If the progressive pool was active, then the event is complete at step 762. If there was a winner at step 752 or there was no progressive pool, the wagering application/web service updates the wager status to win, loss, or push along with payout amount at step 754.

The web service wager application updates the pools and gross payouts amount along with an indication of having paid out through the use of the flag of some sort at step 756. The event is complete at step 764 and the web service then returns to a waiting state for either another event to be created, another bet start date and time to be reached, or another bet and date time to be reached for beginning of another competition.

Still referring to FIG. 1, if a player is scratched or taken out of the tournament or competition for whatever reason, the web service application at step 770 will then refund at step 772 all wagers for that player and the odds are then updated. New wager ID's as previously discussed GUIDS, are sent back to the casino application with a refund flag at step 774. The casino application displays the scratched player at step 776, the wager service sends a request to the casino application to display the scratched player step 780, a wager refund is sent to the banking applications of 782, and the banking application refunds the wagering amount at step 784.

Now referring to FIG. 2, discussion of the wagering database 20 which supports with the wagering web service methods will be provided. The wagering web service database 800 keeps track of the events, players, pools, wagers or bet types, status of the wagers and pools, and the coordination of this information between the casino application, banking application, and the individual wageror either at the casino or at a licensed location.

In discussing FIG. 2, reference will also be made to the wagering web service application 950 which shows some administrative features of the site as seen in FIGS. 3 through 10.

Figure 7:
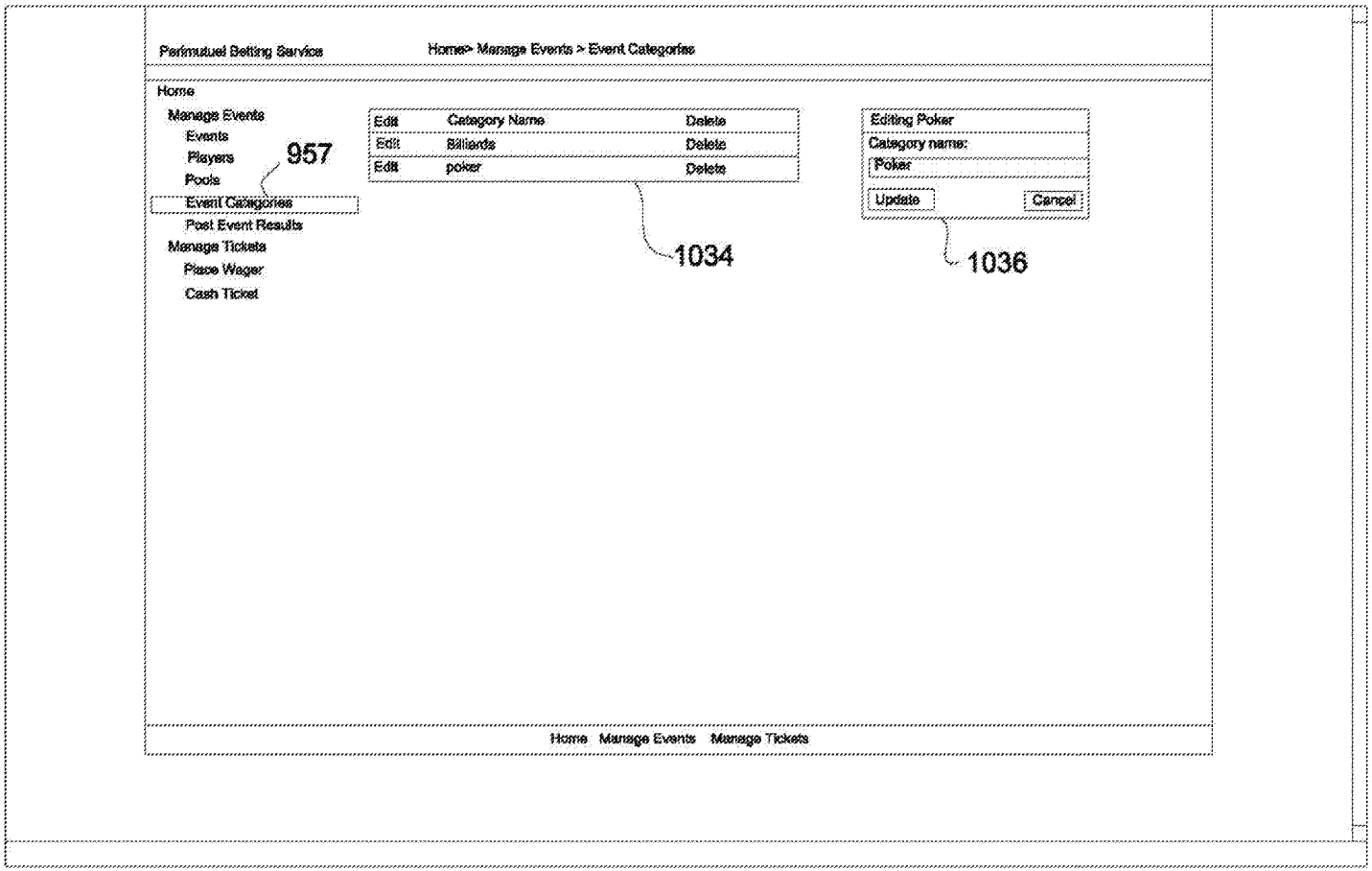
FIG. 7 is a plan view of the event categories page.

The wagering web service database 800 (FIG. 2) can be hosted on a single server or multiple servers with mirroring of the database for security and access purposes. The wagering web service database includes an event category object 802. The event category object 802 correlates with the event categories page 957 as seen in FIG. 7. The administrator can create various categories, or in other words, types of events such as the previously discussed events in the parent applications like, poker tournaments, basketball tournaments, billiards tournaments, marathons, etc. where the administrator can create a category name 1034 which correlates to the category name object 806, which is accounted with a category ID 804. The administrator can enter in the category names in a category name field 1036. The administrator can edit, delete, update, or cancel the various category names.

Figure 4:
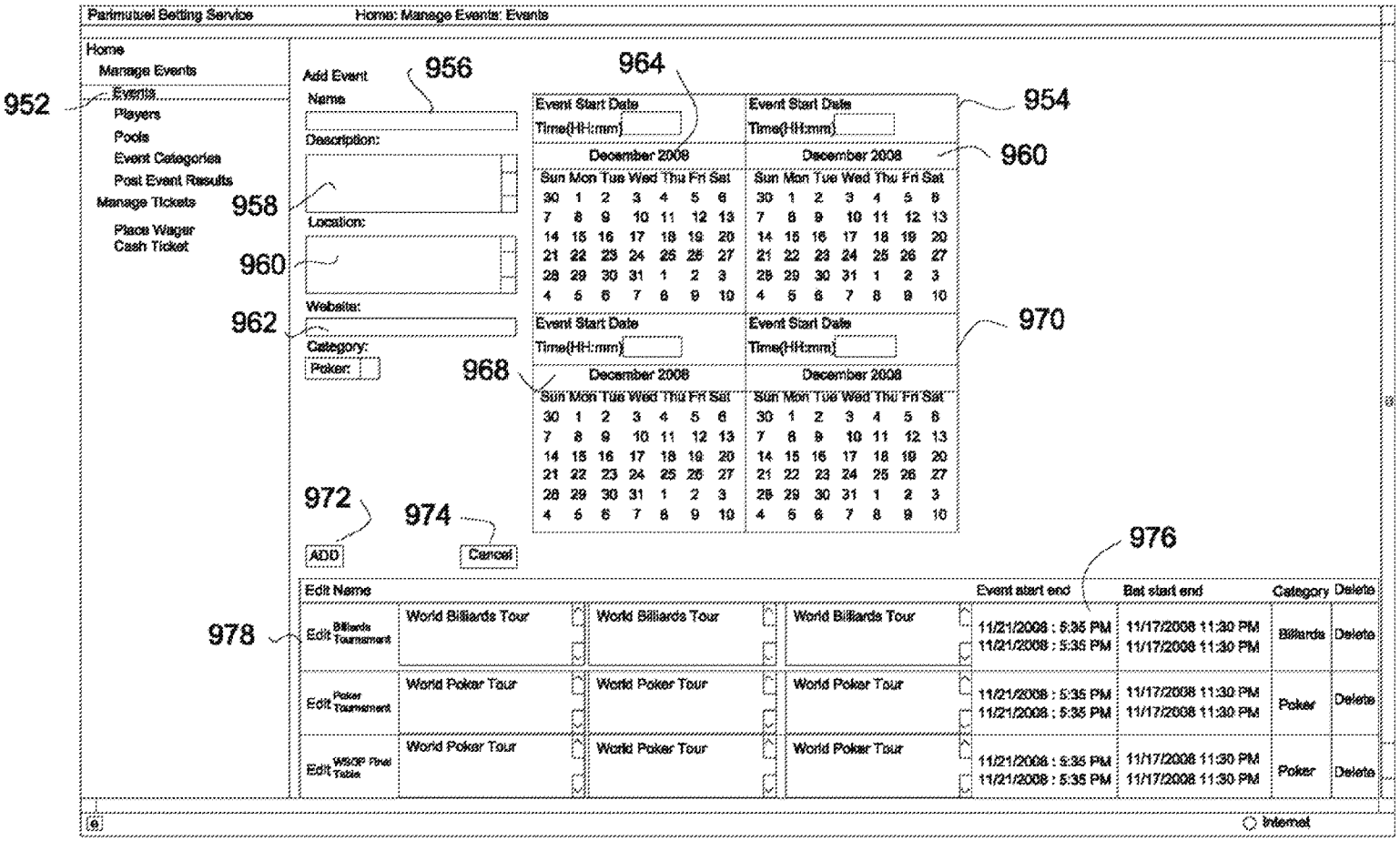
FIG. 4 is a plan view of the events page.

Depending upon the categories themselves are events, where the events are actual contests or tournaments which are either played in real time at a physical location or at a virtual location. These events are organized by category and the event page 952 as seen in FIG. 4 draws from a series of objects in the event object class 808. When a new event is created, an event ID 810 is assigned. The administrator can enter by adding an event at the add component 972 and in doing so creates a series of available fields for the add event component 954. The add event component includes a field for entering the name at field 956 which correlates to the name object 812 which is the name of the event.

A description field 958 correlates to a description object 814 within the database a location field 960 correlates to a location object 816 in the database where the location is the physical or virtual location where the event is happening.

The website field 962 correlates to the asset object 818 in the database. The asset object and asset fields allow the administrators to enter in the particular website or URL where the tournament is located or the event is located. To assign a category to a particular event, a category pull down menu is provided which correlates to the category ID 804 in the category or the event category object 802.

The administrator can select an event start date from an event start date object 964 which is correlated to a database object in the event object 808 which is the event start date time object 822. The event end time component 966 will ask the administrator to choose an ending time for the event which includes the date time in hours and minutes. This component is correlated to an event end date time object 824 in the database.

One can also set the bet start date end time in field 968 which is correlated to the bet start date time object 826 in the event object as well as enter the betting end date and time information in field 970 which correlates to the bet end date time object 830 in the database.

Once the administrator enters in this information, it is reflected in the event management fields 978 which are displayed in the event page 952 for monitoring and quick reference.

With the event category and the event itself established, a number of additional objects and software components are ready to obtain and/or display information. They include the event results object 832 which correlates to the event results page 959 as seen in FIG. 3, the player object 840 which correlates to the players page 953 FIG. 3, the pool object 870 which correlates to the pool page 955 FIG. 3, and then additional objects extend from these secondary object pages to be discussed further below.

Referring to FIG. 5 and in conjunction with a discussion of the player object 840 FIG. 2, the wagering web service 950 can either get players, edit players, or add players to a selected event. The players' page 953 allows the web service to either receive or send the player information from the casino or event application/location dynamically through the XML service or the administrator can enter in manually the players themselves which are then affiliated with a particular event. If acquiring the player information dynamically through an XML feed, the administrator may select the event name 956 and then choose the get players component/button 980. This will then load the player names which include a first name object 844, a last name object 845, as well as a field designation 846. The players are correlated to the particular event ID object 810 and each of the players is assigned a player ID object/account number 842. If a player, for example, has defaulted or scratches then the player is flagged with the scratch object 852.

In the player page 953, the players once they are loaded into the database, are shown in a players' field 992. Here the administrator can edit the player utilizing the edit player component 994, add additional players 982, indicate whether the player is in the field at 988, add or edit the player's first and last names in the fields 984 and 986, as well as cancel the player at 990.

Before the event begins and before the betting or wagering phase of the process, the wagering pools must be established so that individuals who wish to wager on a particular contest can do so. Referring to FIG. 6, discussion of the wagering pool page 955 will be provided in conjunction with reference to the database pool object 870 FIG. 2. The pools can be established either administratively at the wagering web service site or can be established at the event host sites such as the casino or tournament location. Furthermore, a third site unaffiliated with the casino location hosted on a remote computer may be used depending upon the configuration requirements. In order to receive the pool information from a remote location, the get pools component 998 allows the administrator to upload via the XML feed, the pool settings for a particular event or named event 956 selected in the selecting location. The pool can be named in the title field 1002 which correlates to the pool title object 878 in the database.

When the pool is created, a pool status ID object 876 is assigned. The pool page and object has a bet type object 880 which is correlated to the bet-type selector 1004. This selector allows the wagering web service to choose the type of winning ticket. For example, picking either a single individual or entrant to win the contest, or choosing a number of entrants (n) to win in any order or in a particular order within the event or contest. Depending upon the bet type, a pool type 1006 can either be a win or a mandatory payout within the set pool types fields 1000 of the pools' page 955. The pool type 1006 correlates to the pool type object 892 in the database.

Also within the set pool types 1000 section is a commission field 1008 which correlates to a commission object 882 in the database. If the pick (n) bet-type 1004 is chosen, then the administrator can choose the number of pick counts in the pick count field 1012 which correlates to the pick count object 890 in the database.

This pick count field enables the administrator to choose the number of individuals or entrants within a particular contest or event to place in any order or place in a particular order depending upon how the particular rules are set for the wager, up to the number of entrants within the field. The administrator can also enter a maximum wagers amount within the max wagers field 1016 correlates to the wager maximum object 886 in the database. The minimum wager field 1010 correlates to the wager minimum object 884 in the database.

The wager max field 1014 correlates to the wager maximum object 888 in the database. The administrators can also choose a flat payout field 1018 which correlates to a flat payout object 894 in the database.

The service allows the pool page 955 to display the pool status and pool status field 1020, the gross total number of wagers in the gross total field 1022 whether the pool has paid out in either true or false in field 1024 and whether or not this was a previous pool in field 1026. These also correlate to the database objects including the gross total object 896, the paid out object 898, and the previous pool ID object 900. The administrators can update at 1028 and cancel at 1030 as desired, and can also display the current active/closed pool types within the pool type field display 1032 for each particular selected event 956.

Figure 9:
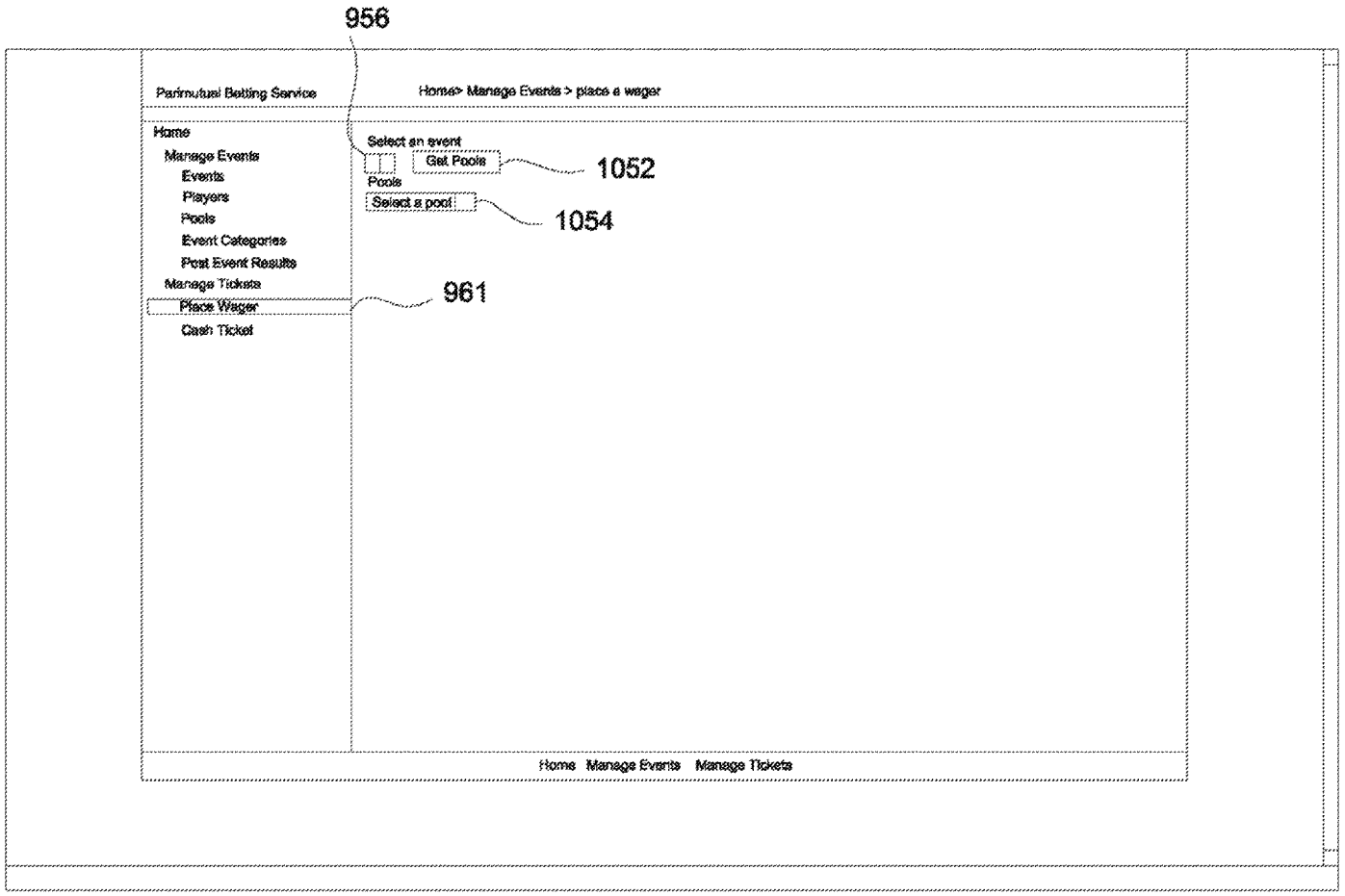
FIG. 9 is a plan view of the wager placement page.

With the pool set and the players set for a particular event, and before the wagering begins, initial player odds are calculated in the player odds object 854. The service will then allow individuals as seen in FIG. 9 to utilize a client side page of the place a wager page 961 for example at a casino location. The web service 950 will receive wager placements from the event location client and the bettor will be able to view the various events by selecting an event at component 956, get the pools for the particular event at 1052, and enable the bettor to choose a particular entrant or series of entrants for wagering on in a particular event or contest within a particular pool type.

During the wagering phase, the player odds object 854 as previously discussed will update the odds for each particular player with the odds object 860. The wager object 902 includes a wager ID object 904 the wager object itself 908, a wager status ID 910 and a payout amount 912. This wager object is reflected in a physical ticket or electronic ticket which the bettor holds to redeem the win. For each particular player, there is a wager detail object 862 which includes the sequence the players placed in the wager sequence object 868. Each particular wager also has a wager status object associated with it 914 which states whether the wager is open or closed and maintains the status object 918.

Figure 8:
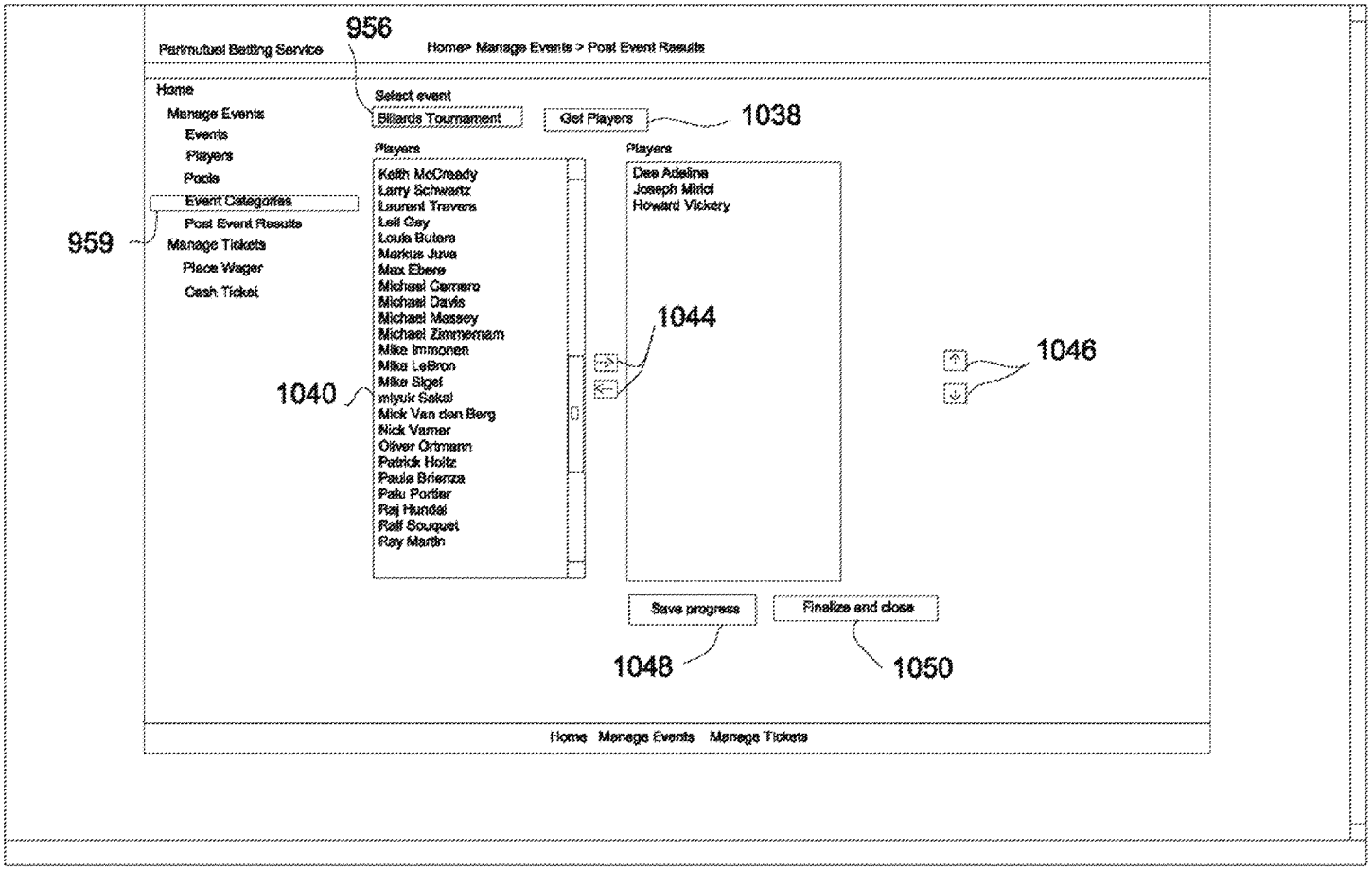
FIG. 8 is a plan view of the posted event results page.

After the wagering is complete the bidding ends and the event is held. After the event or stage has ended, the administrators can either obtain or enter in the post event results page 959 as seen in FIG. 8. Here the administrators can select an event name 956 and get the particular players at 1038. Players are listed in the players' field 1040, and the administrators can utilize selector field arrows 1044 to choose the players who have finished in a particular event and display these players in the finished event field 1042. The players can be ranked and adjusted according to their finishing placements at 1046.

The administrators can save the progress of a particular event if it's still occurring in 1048, and they can also finalize and close the event in 1050. Once the players have or the entrants have finished their play and the particular event is closed, the event finish characteristics field 1042 dictates the end result of the particular pools which were wagered upon and individuals who did wager, can utilize the cash ticket page 963 to enter in their ticket ID at field 1056 and obtain the payout 1058.

II. Real Time Parimutuel Wagering System and Method

Figure 11:
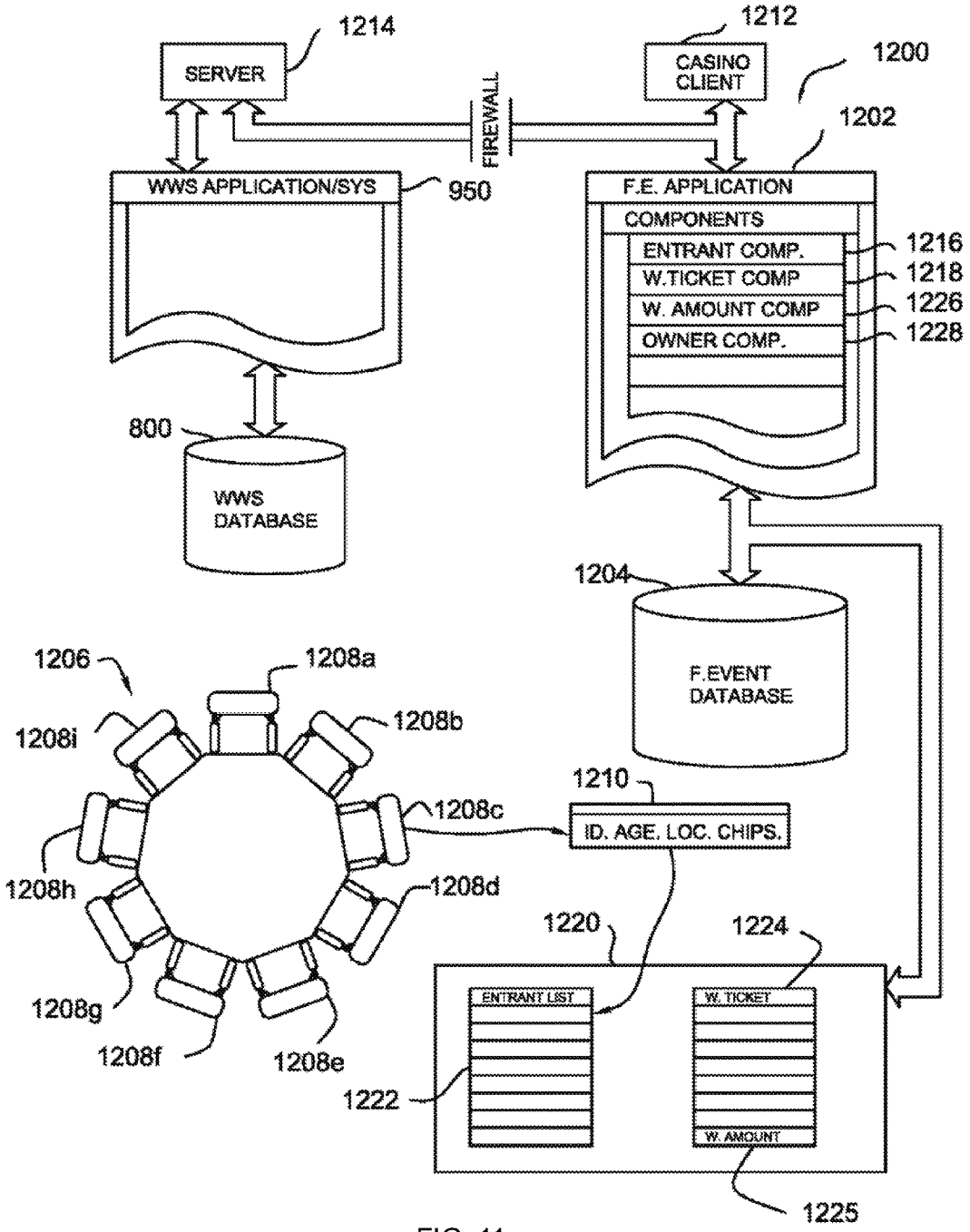
FIG. 11 is a schematic plan view of the wagering system.

Another example of the present invention is a final event pari-mutuel wagering system 1200 as seen in FIG. 11, where players or participants in a pari-mutuel wagering contest can bid on the entrants in a final event 1206. As previously discussed in the above applications which are incorporated herein by reference, the final event may be for example, the final table of the World Series of Poker, the final level in a billiard's tournament, or the quarterfinals or semifinals in a sporting event such as a tennis tournament, soccer tournament, football tournament, basketball tournament, baseball tournament, etc. Furthermore, the final event can be for an interim event within a tournament, such as the 2nd game in a series, or it may be for a one time event not within a tournament setting.

In this present embodiment, the final event to be implemented within the final event pari-mutuel wagering system 1200 will be the final table of the World Series of Poker. Here the final table has in this particular embodiment, nine players or nine entrants 1208*a* through 1208*i*. The nine entrants are arranged about a nine sided table or a nonagon table.

The system includes as previously discussed (the incorporated by reference application) the wagering web service application 950, which interoperates with a wagering web service database 800. A wagering web server 1214 operates as a virtual total-stator system and provides for the interaction between the casino client 1212 in the wagering web server system 950. The software application which may be a customized land-based application to be maintained behind the casino client/server/firewall for security purposes, holds a plurality of components which among other items include a player object 1216, a wagering ticket 1218, a wager amount 1226, and an owner ID 1228.

The player component 1216 is a listing of the entrants 1208*a* though 1208*i* as previously discussed in the final event 1206. The player information is initially called from the player object 840 in the database 800. The wagering ticket component 1218 is called from the wager object 902 in the database 800 as seen in FIG. 20 of the prior application.

The wager amount component 1226 provides a listing of wagering price amount options for choosing a particular amount to wager by the player or the entrant in the final event.

The application or final event application 1202 interoperates with the final event database 1204 to maintain for accounting purposes among other casino specific reasons, the status of the pools as they are built prior to the closing of the bidding phase of the pari-mutuel wagering event, as well as information redundancy and unique wager ticket data information as it is accumulated during the bidding phase.

An instance of the final event application 1202 is executed for example on a kiosk or other type of wagering client 1220 (a client being a PC, laptop, handheld device such as a wirelessly enabled PDA, cell phone, iphone, or mini computer) which is located on the premises of the casino.

In this particular embodiment, the final event player list 1222 shows the final entrants in ranking of chip count. Here the final event player list or table 1222 includes the player or entrant ID, the entrant age, the entrant geographic origination location, and the entrant chip count, all of which are herein referred to as the entrant characteristics 1210.

It should be noted that this entrant characteristic information 1210 can also be sent from the casino client 1212 to the wagering web server 950 and the wagering web server database 800 for administration of the final event. This would occur prior to the beginning of the bidding phase of the pari-mutuel wagering on the final event, when the administrators set up the wagering events on the wagering web service overall system as previously discussed in the prior application.

Included in this particular embodiment on the same screen would be an instance of a wagering ticket 1224. The tickets include a plurality of fields which in this case are nine fields 1223, each for customized ranking 1 through 9 of the entrants at the final event in order of "finish" which in other words may mean the order in which the entrants at the final event poker table leave the table. Of course other "finishes" can be provided such as the first player or the first entrant to leave the table, the last two entrants to play at the table, the top three entrants to play at the table etc.

The player enters the wager amount 1225 which is presently enabled as a pull-down listing which may range from approximately $2.00 per ticket to approximately $2,000 per ticket depending upon the amount wished to be wagered. Of course a greater amount can be allowed by the administrator at the wagering web service system 950 as previously discussed in the prior application.

With, for example, the final nine entrants at the final event 1206 of the World Series Poker, the un-handicapped odds for choosing the final winner may be 9 factorial:1 or in other words. 362,880:1. Copies of each wagering ticket 1224 are stored in the final event database 1204, sent to the Nevada State Gaming Commission Board (NSGCB), the ticket is printed with the unique GUID ID as previously discussed in the prior applications, and the administration wagering web service system 950 maintains a copy of the wagering ticket information in the wagering web service database 800.

Figure 12:
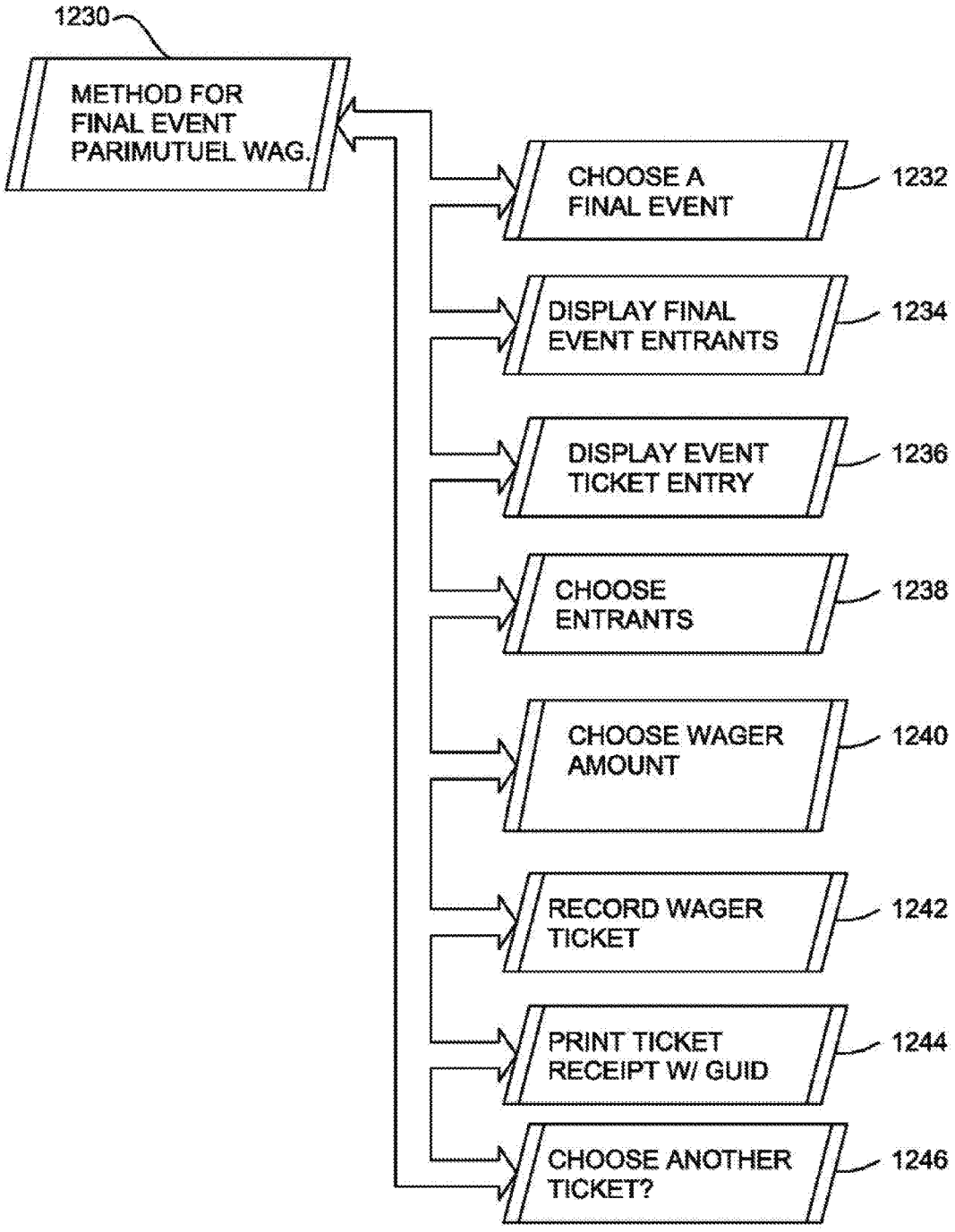
FIG. 12 is a schematic flow chart of a method for using the wagering system.

A discussion will now be provided of the method for final event parimutuel wagering 1230 as seen in FIG. 12. Overall, the steps include choosing a final event at step 1232, displaying the final event entrants at step 1234, and then displaying an event ticket entry at step 1236. Next the user can choose the entrants at step 1238 for ranking, choose the wager amount at step 1240, and record the wagering ticket at step 1242. The user will then be able to print the ticket receipt with the GUID at step 1244 and then choose another ticket for wagering at step 1246.

The player or user at step 1232 may be able to choose a final event from a listing of final events such as the final World Series of Poker table. As previously discussed, the final event World Series Poker table 1206 would have the entrant characteristics 1210 listed within the final events player list 1222 showing say, for example, a kiosk, where the player can view the current ranking of the players or entrants, and make a proposed finish list occurring at the final event and place this information into the wagering ticket 1224 fields 1223.

At step 1234, the final event entrants are displayed as previously discussed in the kiosk where the entrant characteristic information 1210 is called from the casino database or final event database 1204 which is then executed on the casino application or casino service final event page displayed in the kiosk or wagering client 1220.

At step 1236, the event ticket entry is displayed on the kiosk or wager client 1220 in this particular embodiment in tandem with the final event entrant list 1222. The event ticket entry 1224 is executed from the client or casino application or casino service final event application 1202 which itself calls the details of the wagering ticket for the particular pool from the pool object in the wagering web service database 800 hosted on the wagering web server 1214.

After the player chooses the entrants at 1238 and ranks their proposed finish, the player will choose the wagering amount at 1240, and then record the wager ticket at step 1242. This information is re-corded into the casino service database 1204 and the wager ticket details are sent to the wagering database 800 on the wagering web server 1214.

The player can then print the ticket receipt with the GUID 1244 which is correlated to that unique particular ticket as previously discussed in the prior applications incorporated herein by reference.

Figure 13:
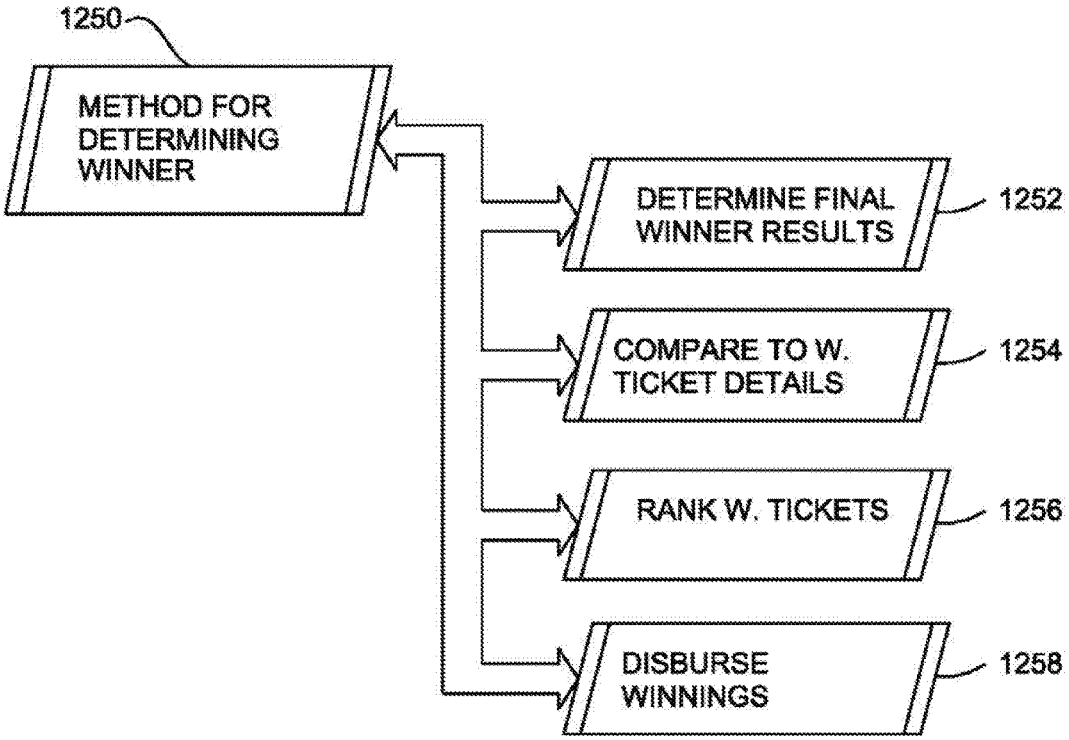
FIG. 13 is a schematic flow chart of a method for determining the winner.

Once the bidding phase is closed and the event has taken place, a method for determining the winner at step 1250 as seen in FIG. 13 is utilized. Here the casino application 1202 determines the final results at step 1252 and posts these final results to the wagering web server 1214. The final results are then compared to the wagered ticket details at step 1254. The player who has the most "winners" in the allotted fields is determined the winner of that particular pool.

In other words, at step 1256, the administration application or wagering web server system 950 ranks the wagering tickets based on the most correct entrant finish placement positions. In the case of a tie, the wagering pool is divided evenly among the players who have chosen the same number of entrant finishers. In one embodiment, there will be no carry-overs.

The winnings are dispersed at step 1258 and the final event application 1202 displays the winning amounts and the winning player while notifying all others that the event is closed.

Figure 21:
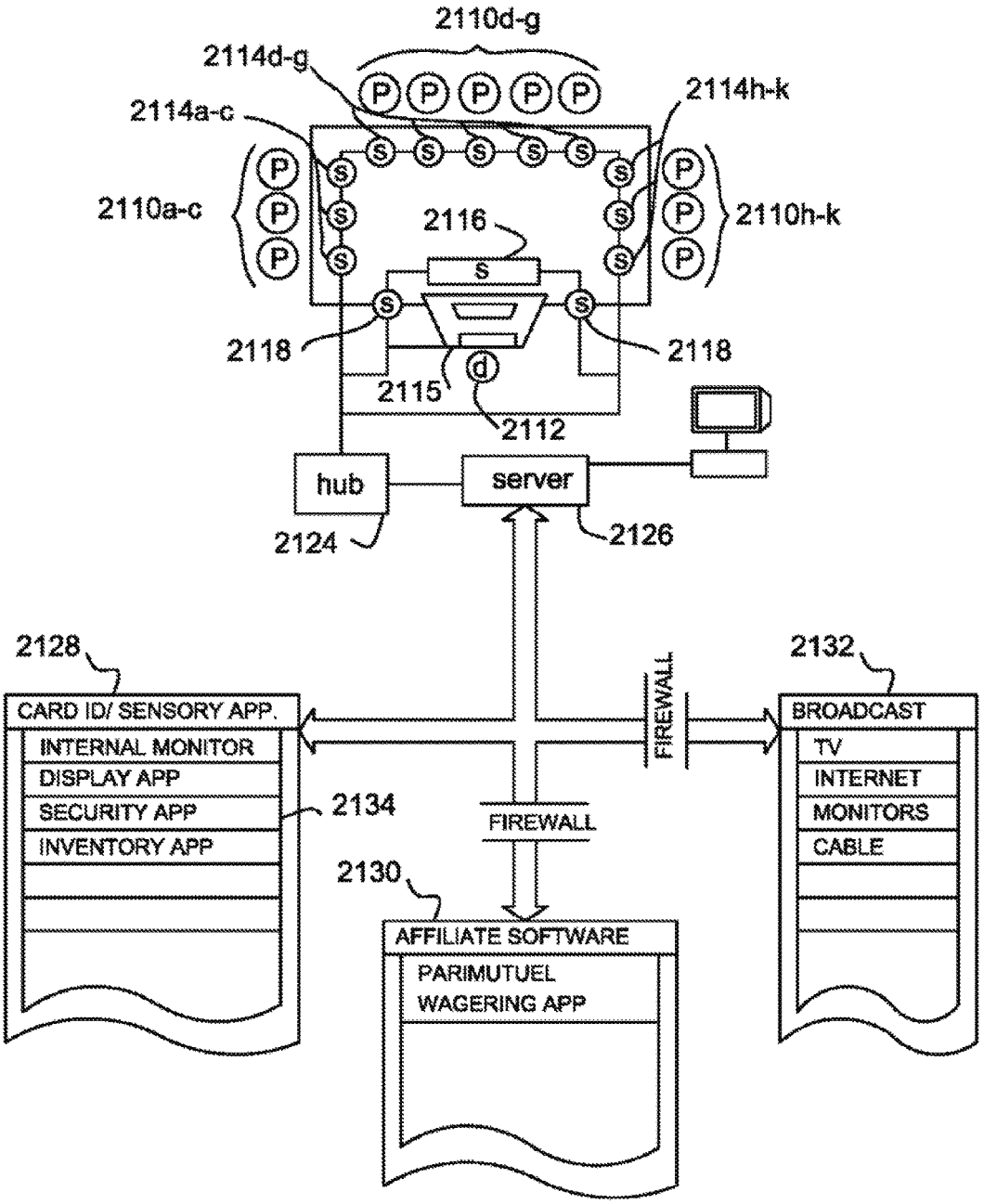
FIG. 21 is a schematic plan view of a sensory system in a game environment.
Figure 22:
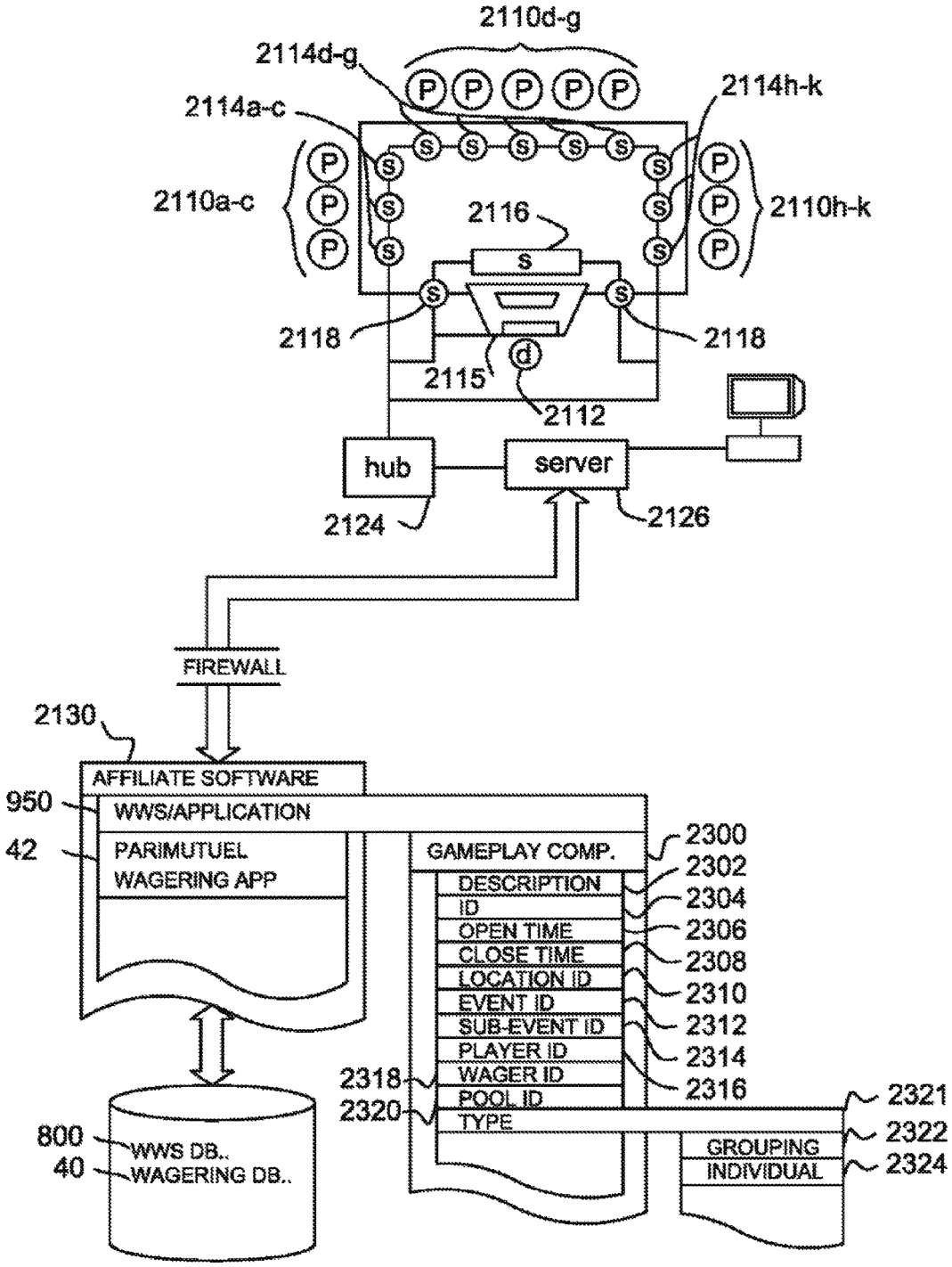
FIG. 22 is a schematic plan view of a wagering application interoperating with the sensors in a game environment.

To provide for real-time monitoring of game play events as they unfold, the wagering application 42 as seen in FIGS. 21 and 22, interoperates with the wagering Web service application 950 and the sensory application 2128 in order to interoperate with the tracking or sensor mechanisms associated with the event. For example, the real-time monitoring enables wagers to be made on basic game play events as they unfold. This may include, for example, in a poker playing tournament, wagers on the outcome of a particular hand, the outcome of a particular deal, the outcome of a particular game, the outcome of a particular discard, or other event which may occur during the real-time play of the game. This enables spectators of the event who may have familiarity with the particular event to wager on the likely outcome of a particular event or sub event occurring within the game. These games of skill enable outside spectators to make informed judgment calls in wagering on the events. In other words, the more familiar an individual is with the particular event, the more likely they are to make a wager which has a successful outcome based on their knowledge of the game.

The wagering Web server application 950 will include a game play component 2300. The game play component has a corresponding game play database field which resides within the wagering Web server database 800. The game play component has a number of attributes or sub-components which enables the game play component to adequately reflect the real-time conditions of the game objects within the event. The game play component includes a description component 2302 for describing the particular game play component being modeled. An accounting ID component 2304 for tracking within the database and monitoring of the correlated object in the event. An open time component 2306 which records the time that the game play component was entered into the event. A close time component 2308 which also records the time that the gameplay component exited the event. A location ID component 2310 which is for assignment purposes to either a player ID component 2316 or a physical location such as a table in the casino, or other location such as a URL for a virtual web gaming site. The event ID component 2312 which identifies and correlates the gameplay component 2300 to the particular event which is being wagered upon or monitored. A sub event ID component 2314 which may be, for example, the event of an outcome of a particular hand, the event of an outcome of the particular pool shot, the event of an outcome of a particular race stage, or any other type of sub event which occurs during the main event of the game.

A brief example will be discussed in regards to the event and sub event correlation. For example, the poker game event may be the previously discussed nonagon nine event. The sub event may be the change in overall chip count of one particular player, the likelihood of a particular player to fold or bluff in a particular stage of the game, the likelihood of the player to up the ante in a particular stage of the game, the likelihood of the player to call etc.

Additionally, the game play component 2300 also includes a wager ID component field 2318 which correlates to the wager ID 904 in the wagering Web server database 800. The game component also has a pool ID component 120 which correlates to the pool ID object 872 in the wagering Web server database 800. In addition, the game play component also includes the game play component type 2321. The game play component type is essentially an indication if the game play component is a class of sub game play component or as an actual game play component item or object. For example, the game play component 2300 may be a deck of cards. If this is the case, then the game play component must create a game play component grouping 2322 which affiliates the individual card components of the deck to the deck game play component for accounting purposes. Each of the individual card components would initialize onto the individual game play component type 2324, while the deck itself would initialize under the game play component grouping type 2322.

The game play component objects are configured to receive data from the event that is being hosted at the location. In order to more fully describe this, a discussion of the data generated at the event will now be provided.

In order to properly track and display the card game as the game progresses, in one embodiment tracking and sensor technologies are utilized in order to identify which cards players have in their hands and which cards are either discarded or still within the deck so that additional wagering events can be made on the outcome of players hands during the game and also during the course of the pari-mutuel wagering event.

Accordingly, a detailed discussion of various embodiments of the interactive playing card 2010 as associated with the sensors which send and receive information from the readable data component described below will now be discussed.

Figure 14:
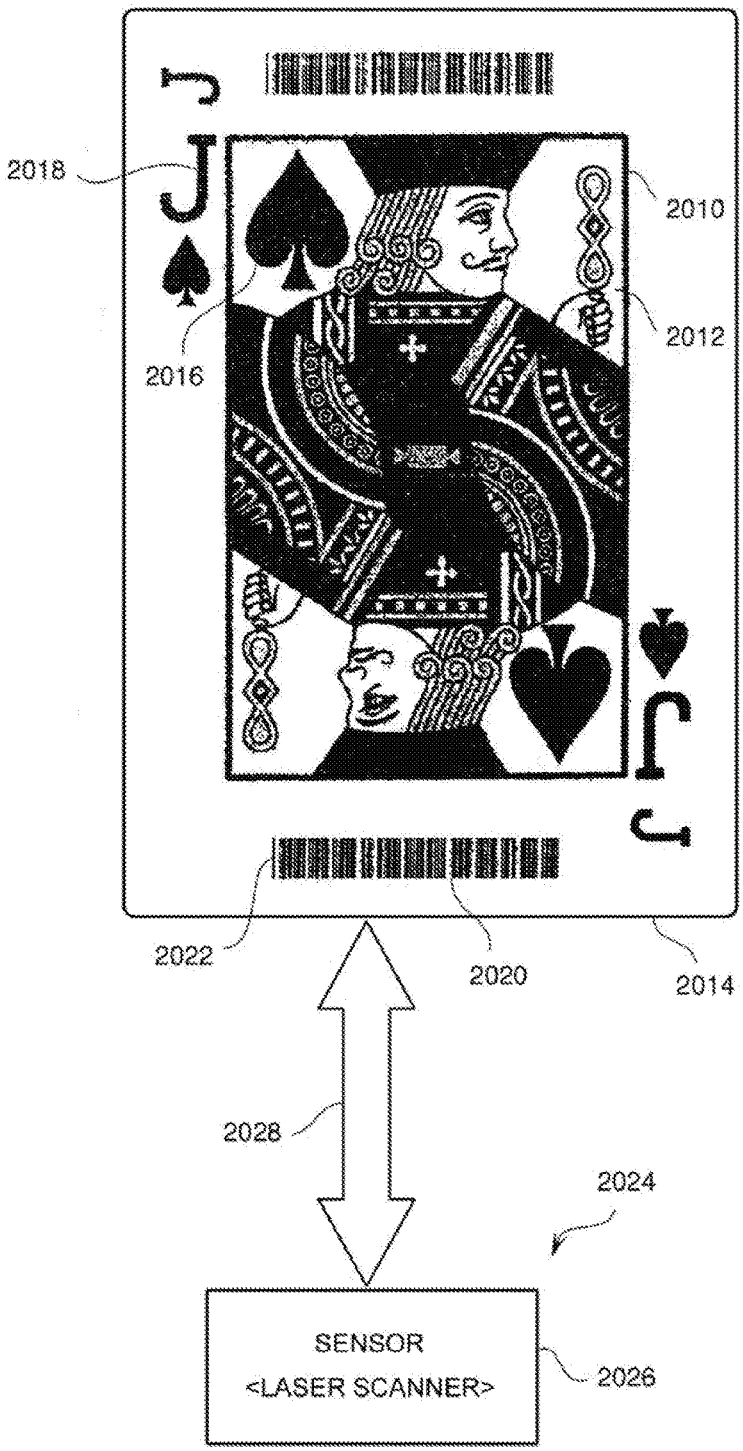
FIG. 14 is a plan view of an interactive playing card.

What follows is a discussion of the interactive playing card 2010 as seen in FIG. 14, which has one, two, or three dimensional bar codes or an RFID chip located or interoperating with the playing card. The bar codes and/or chip can be placed on the face of the card surface, embedded within the card surface, or layered between various stratums of the playing card.

The information to be transmitted to the sensor 2024, is contained within a readable data component 2020. The readable data component can be the bar codes as discussed above, the RFID tag, or a combination of the above to contain or maintain data during the use life of the card.

Referring now to FIG. 14, the interactive playing card 2010 is configured with the readable data component 2020. The readable data component 2020 in this particular embodiment is a one dimensional bar code 2022. A sensor 2024 can read the data component 2020 by, in this case, a laser scanner 2026. The readable data component 2020 maintains a suit card element 2016 and a face value card element 2018. These card elements are correlated to the suit of the card 2010 and the face value of the card 2010 as seen on the front face 2012 of the interactive playing card 2010.

The one dimensional bar code 2022 has encoded data or information as a two dimensional array of adjacent parallel rectangular bars with spaces of varying widths. As is generally known in the art, a bar code typically has identification data encoded within it; this ID data or key is used by the computer. The computer receives the laser scanner 2026 information such as the infrared laser signal 2028, to query the database and correlate the ID with the associated record information within the database. For example, a bar code found on a loaf of bread does not contain the product name, type of bread, or price. Instead it contains a digit product number. When the bar code is scanned at the checkout, it is transmitted to the store's computer, which finds the record associated with that item number in the database. The matching item record contains information such as a description of the product, vendor name, price, and quantity on hand. One dimensional symboligies include UPC\EAN, code 39, code 2128, interleaved 2 of 5 and Post NET. Code 2128 and interleaved 2 of 5 are popular in the transportation industry. One dimensional bar codes are read by a sweeping of a small spot of laser lights (which may be an infrared laser) across the printed bar code symbol. A human eye will only see a thin red line emitted by the laser scanner; however the scanner light source is absorbed by the dark bars and reflected by the light spaces. This light signal 2028 is then read by the sensor 2024 and converted into an electrical analog signal. The digital filter in the scanner then converts the analog electrical signal into a digital signal, which is then interpreted by software as the item number.

A one dimensional bar code item number is analogous to a serial number. By itself, serial numbers are not particularly valuable. However, when combined with, as discussed below, an inventory database, and tracking stations, the serial number becomes valuable because the company's enterprise systems can derive information from the data collected about what the product is and where the product was last scanned.

This derived information can then be used to feed the downstream supply-chain applications that rely on the product flow information. The one dimensional bar code represents unique identifiers like a serial number, but it can also represent a class of items such as a part number. Identifying unique items, classes of items, or both is a conceived embodiment of the one dimensional bar codes as used in this particular embodiment. The one dimensional technologies are tethered to the enterprise system which they read into. As the number of partners using the ID increases, the number of disparate enterprise systems increases and thus the information exchange costs proportionally increase.

With the use of the one dimensional bar code technology, granular data is developed and/or generated with regard to the approximate locations of the product within the distribution chain. The one dimensional bar code 2022 located on the interactive playing card front face 2012, enables the producers of the interactive playing card 2010 to integrate and track the card as well as card decks while using mature supporting technologies i.e. the bar code scanning technology. While discussion of the barcode 2022 has been on the front face of the playing card, the bar code can be placed on the back face 2014, integrated into the graphics of the card, or added on to the edge of the interactive playing card 2010.

Figure 15:
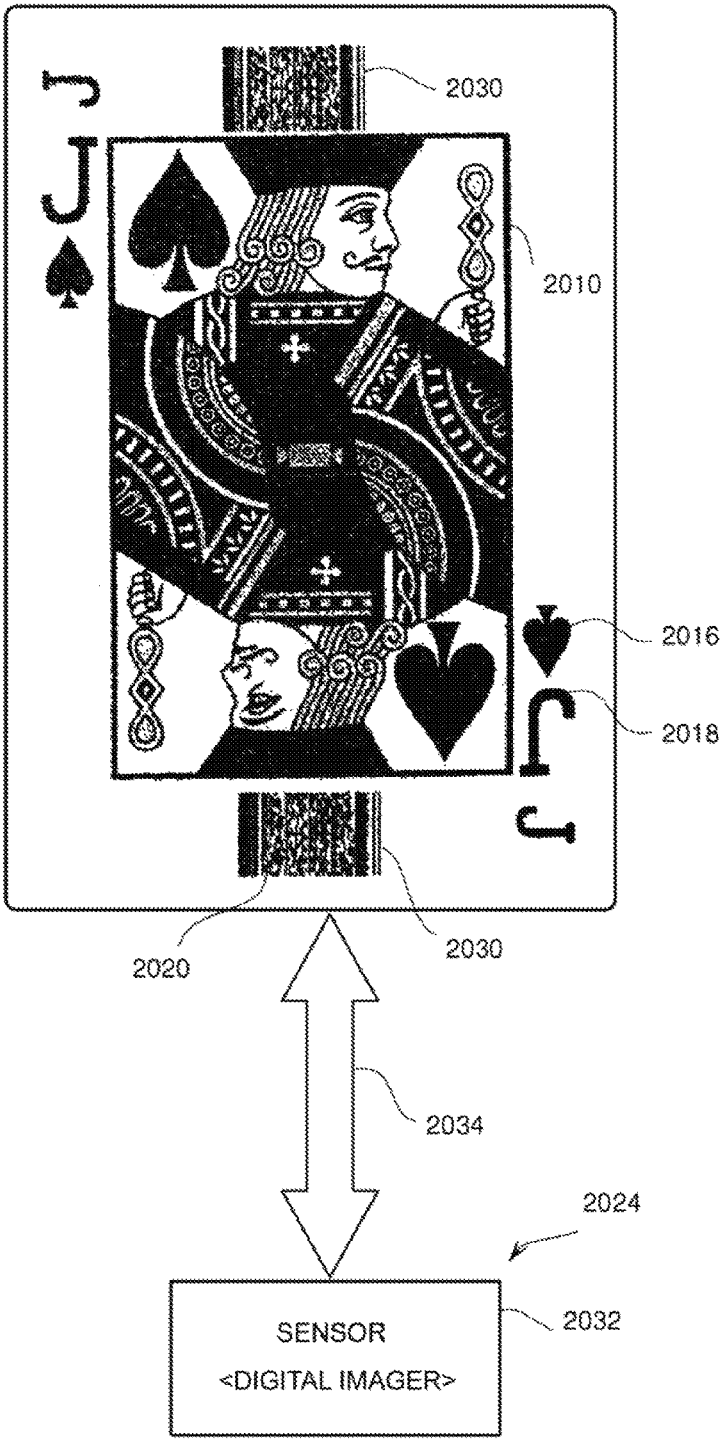
FIG. 15 is a plan view of an alternative embodiment of the interactive playing card.

Referring to FIG. 15, the interactive playing card 2010 utilizes a readable data component 2020 which in this case has a two dimensional bar code 2030. The two dimensional bar code also maintains the existing face value card element 2018 and the suit card element 2016. In addition to the previously mentioned data element, additional data components also include a client element where the client may be a casino, or a particular server location with a discreet domain. Also, a printer element which records the particular printer used to generate the data component, a card deck element which can be a serial number representing the unique actual card deck the playing card belongs to, an assigned table element, which may be correlated to the table using the pack or the deck when that particular deck is opened upon first use or subsequent uses, an assigned card game element which is correlated to the games being played at the particular table when the pack is initialized for use. A number of deals per deck element sets the number of times that the deck can be used before the deck is retired. Also, a date the deck is retired element can be correlated to the card deck element serial number for tracking within the system.

A card deck in inventory element correlates the card deck to the other card decks within the inventory.

Also, a date of destruction element can be correlated to the serial number element when the card deck is taken out of inventory and destroyed. Further, a date of sale of used deck element can be assigned and correlated to the serial number element when the deck is sold and taken out of use by the client.

The above information can be encoded or correlated to the two dimensional bar code 2030 because of the two dimensional matrix symbology enabled by the horizontal and vertical axial components of the 2D matrix. Each two dimensional matrix code 2030 is created as a matrix of square elements, each element being either white or black which enables the printer to generate and encode data as binary code. This allows for a very large amount of data to be correlated with the matrix symbol and along with extensive error detection and correction codes, the information can be coded in a very small amount of space.

The 2D matrix bar code 2030 is read with a digital imager. This permits very fast data collection by capturing the entire symbol at once, because the sensor can recognize the two dimensional bar codes pattern of cells contained within the matrix. The cells can be square, hexagonal or circular in shape. This data is encoded relative to various horizontal and vertical positions as well as light and dark areas. Encoding schemes use error detection and correction techniques to improve reliability, and enable reading of partially damaged symbols. Two dimensional bar codes are generally used where between 10-20 data characters are desired for recordation of information. As discussed above, the 2D bar code 2030 enables additional information beyond the one dimensional bar code as seen in FIG. 14, while still maintaining the two dimensional bar code on the surface of the playing card 2012.

Figure 16:
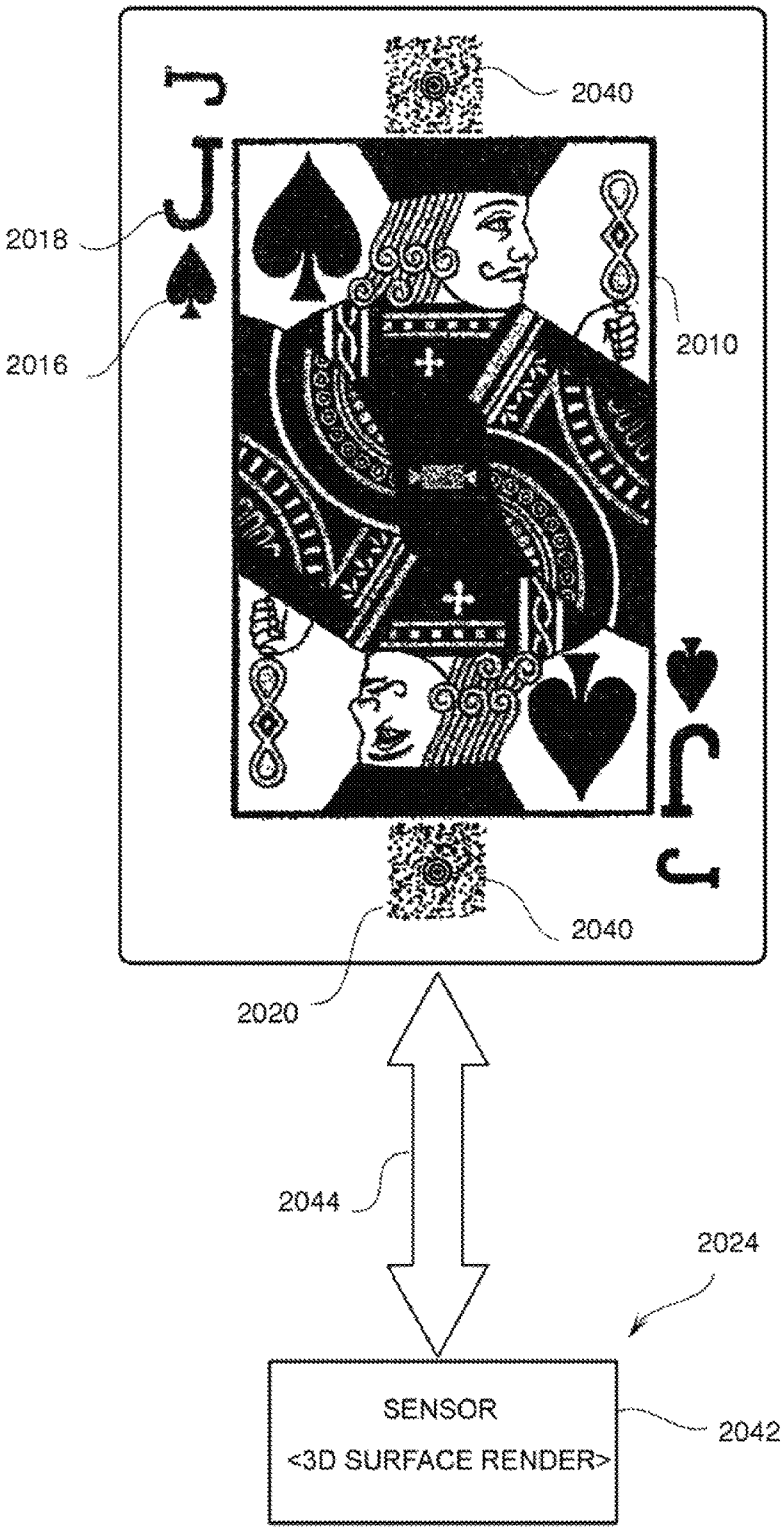
FIG. 16 is a plan view of an alternative embodiment of the interactive playing card.

Referring to FIG. 16, a three dimensional bar code 2040 is used on the interactive playing card 2010 and interoperates with a sensor 2024 which in this particular embodiment is a three dimensional surface reader. The three dimensional bar code 2040 or in other terms called a 'bumpy' bar code, maintains also the suit card element 2016 and the face value card element 2018 which are correlated to the playing cards suit and face values. The previous additional information included in two dimensional bar codes, as seen in FIG. 15, can also be recorded within the three dimensional bar code 2040. The sensor 2024 as previously discussed is a three dimensional surface reader 42 and reads the bar code 2040 which is directly embedded within the card 2010. The signal 2044 is a surface sensing signal which is read by the 3D surface reader 42.

Represented by highs and lows at surface height, similar to Braille, as well as indentations, contours, casts, penned, etches, stamped, molded or embossed three dimensional codes are embedded into the card 2010. The 3D bar code 2040 enables the user to collect data in environments where the black-and-white bar coding technologies are ineffective. Permanent marking of components is enabled, in this case the playing card 2010, generating increased tracing capabilities. In the present technology, the 3D bar code 2040 allows the playing card surface 2012 to avoid having additional ink visible on the surface of the card, and the 3D bar code works the same software data transfer as the one dimensional bar code 2022 (FIG. 14).

Figure 17:
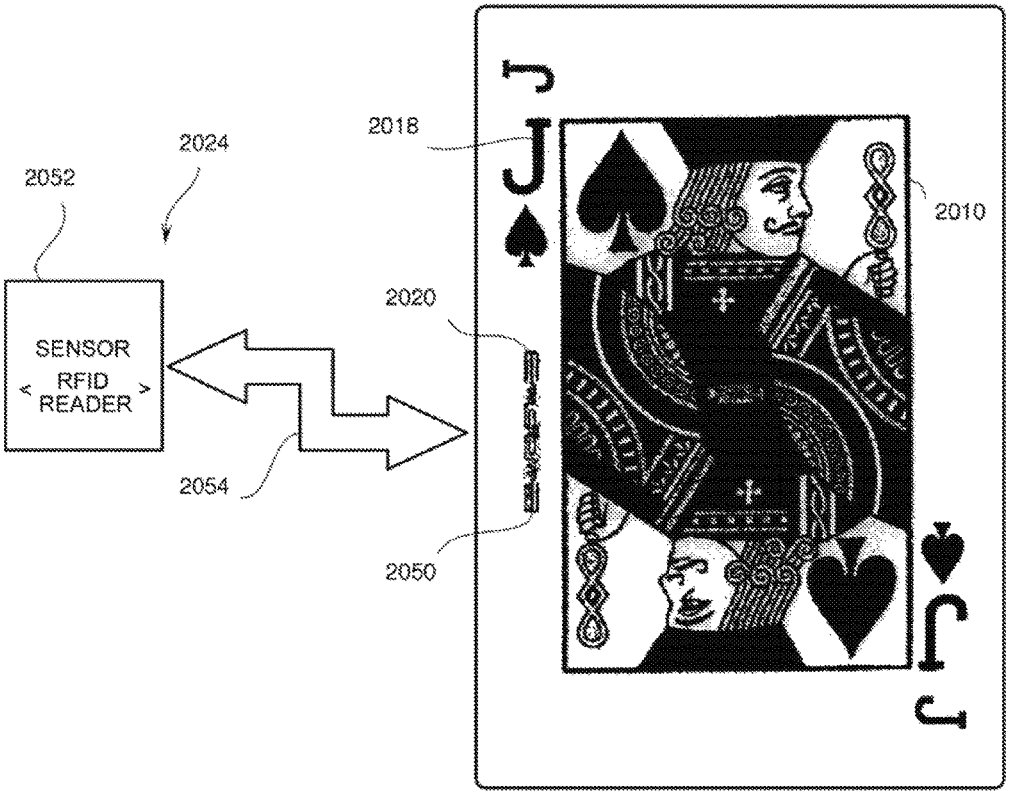
FIG. 17 is a plan view of an alternative embodiment of the interactive playing card.

Referring to FIG. 17, a radio frequency ID tag 2050 is attached to the interactive playing card 2010. The readable data component 2020 or in other words the radio frequency ID tag 2050, maintains the suit card element 2016 and face value card element 2018 of the playing card suit and face value. Due to the large amount of data which can be maintained by RFID tag 2050, additional information can be maintained within the circuit. The small radio frequency ID chip 2050 is read by a sensor 2024 which in this case is an RFID reader or scanner 2052. The scanner interprets the card suit element 2016 and the face value element 2018 via the software which interoperates with the sensor 2024. Radio frequency ID is a capture technology that uses small data carrying tokens or tags, and fixed or mobile scanners or in other words the readers.

The tags are attached to or embedded into objects to be identified and/or scanned. The RFID tags can be active or passive. In alternative embodiments, the RFID tag 2050 may be an active tag, a passive tag, or in a passive sense, a Nano tag which is an RFID chip built at the micron level.

The active tag includes a battery of some sort, while the passive tag obtains energy from the radio frequency signal 2054 sent from the interrogation unit 2052 or the reader 2052. The passive tag maintains the identification information or readable data components for the life of the tag. The active tag has a greater transmission range because of the power source maintained in operation with the active tag 2050.

The sensor 2024 or in this case the RFID reader 2052 is installed throughout for example, the casino such as within the playing table, above or below the playing table etc. Also, the reader 2052 may be portable. The data within the RFID tag 2050 is transferred between various distributed readers 2052 within a hosting environment via local area network or wireless area networks as discussed below.

The signal 2054 is a low-power radio frequency signal. In one particular embodiment, the RFID tags are embedded with custom integrated circuits to maintain the data. In general, using the RFID tags on items such as the playing cards 2010 enable the items to be tracked in real time and the items do not need to be handled by humans, i.e. the RFID tags can be polled by sending out interrogation signals and receiving the correlating response signal. This minimizes the time involved in the identification process of locating the cards 2010 and enables high integrity of the data.

In this current embodiment, still referring to FIG. 17 the RFID tag 2050 is embedded into the interactive playing card 2010 during the production phase of the card. The RFID tag enables the value of the card, suit of the card, and other data points to be transmitted through the RFID sensor 2052 into the operating software. In addition, RFID chips can be attached to the interactive playing cards 2010 after manufacturing of both the playing cards and the RFID tags 2050 during separate processes where bar code technologies would be less effective. Permanent marking of the playing card 2010, generates increased tracing capabilities.

The sensors 2052 as discussed more fully below are enabled to read the RFID tags 2050 and can be mounted on the playing surface of the gaming table, underneath the gaming table, or over the gaming table. With the use of RFID, deep visibility of real-time data is enabled for polling of the interactive playing cards 2010. The RFID tags 2050 and the packaging of the decks, allow for detailed data to track the items through the casino supply chain.

In this particular embodiment, the RFID tag 2050 enables additional integration with inventory control, accounting software, and data aggregation, collection, and/or dissemination of information to interested third parties. Using the RFID tag 2050, real-time polling enables the existing database to keep track of the existing inventory of cards, and avoid the use of inventory cycle counts.

Referring to FIGS. 8-10: the readable data components can be applied to the interactive playing card 2010 independently or combined to realize various combinations and sub combinations of data aggregation and scanning depending on the existing capture system, i.e. the bar code scanners or the RFID readers.

For example, referring to FIG. 20, a composite sensor 2024 incorporates the use of a laser scanner and an RFID reader 2060, and receives two separate signals, the RFID signal 2054 and the infrared laser signal 2028. On the interactive playing card 2010 are both the one dimensional bar code 2022 and an RFID tag 2050 which can be either passive or active depending on the desired metrics.

Figure 18:
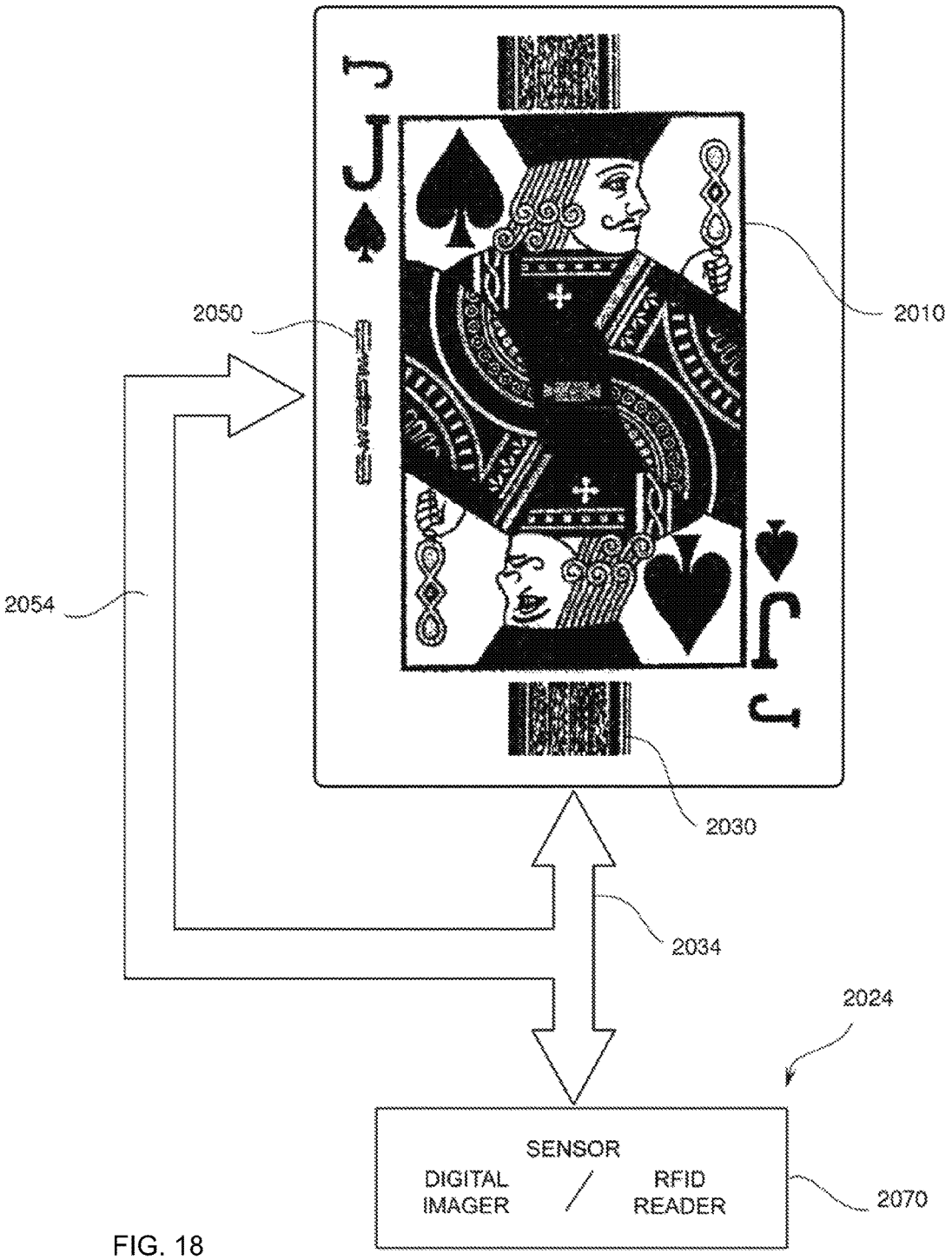
FIG. 18 is a plan view of an alternative embodiment of the interactive playing card.

An alternative embodiment utilizes a sensor 2024 with a digital imager and RFID reader composite sensor 2070 as seen in FIG. 18. Here the two dimensional bar code 2030 and the RFID tag 2050 are interoperating with the interactive playing card 2010. Again the various signals such as the RFID signal 2054 and the image signal 2034 are read by the composite sensor 2070 to aggregate and track the various information in the respective readable data components.

Figure 19:
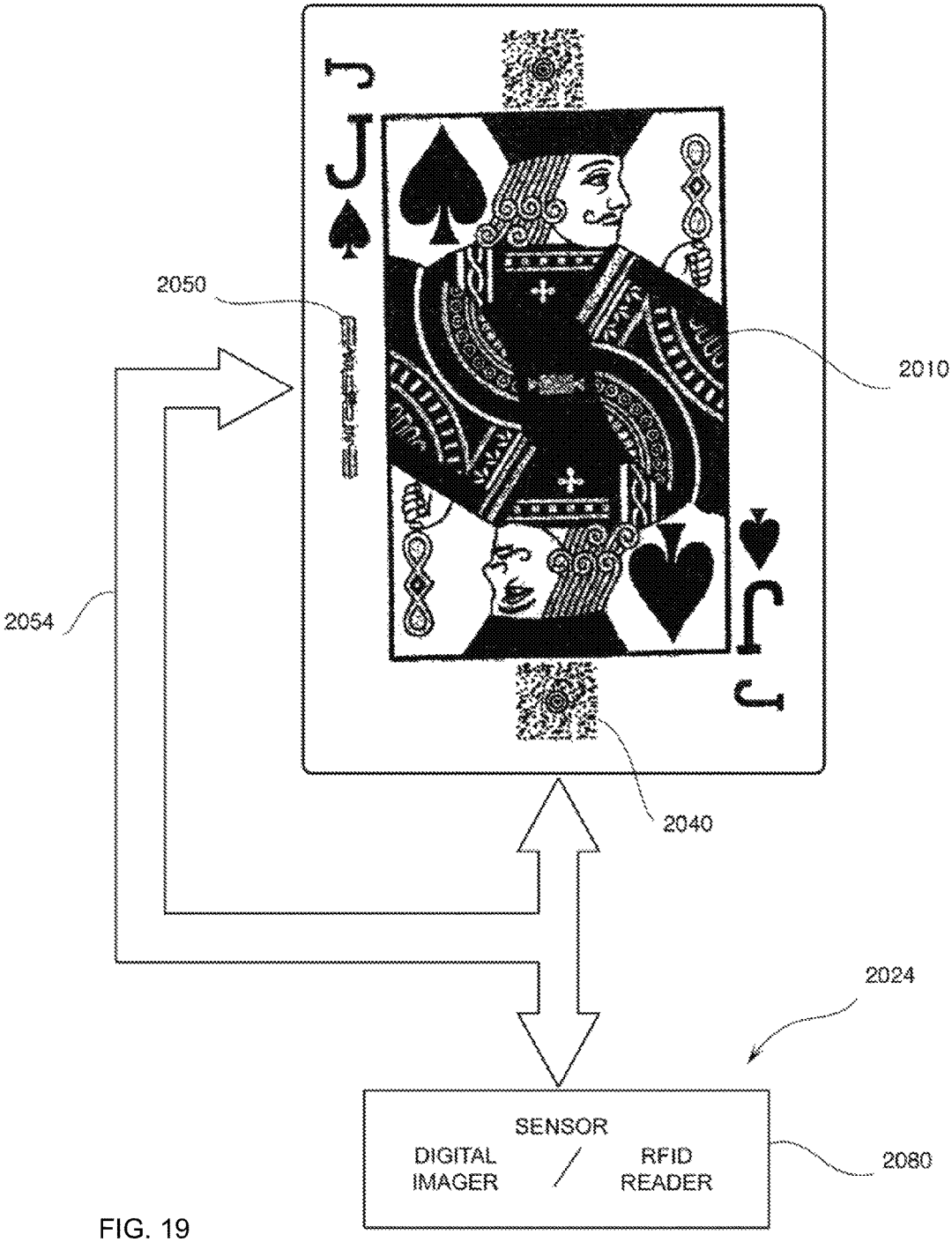
FIG. 19 is a plan view of an alternative embodiment of the interactive playing card.

Lastly, referring to FIG. 19, a three dimensional surface reader in combination with an RFID reader composite sensor 2080 receives the surface sensing signal 2044 and the RFID signal 2054 to read both the three dimensional bar code 2040 and the RFID tag 2050 maintained on the interactive playing card 2010.

As will be discussed below, the interactive playing cards 2010 operate in gaming environments, either live or online, as well as a combination of the two where the use of real playing cards is desired. The interactive cards 2010 are handled in the traditional manner and are required to be dealt by a live dealer or person, and are required to be shuffled etc. The sensor or sensors, maintained within the gaming environments translates the readable data component information maintained on the card to software maintained within the microprocessor environment which enables the gaming software to display the information maintained within the readable data component 2020 such as the face value element 2018 and the suit card element 2016 on either a screen at a client computer or on a monitor of some sort for spectators or guests to view.

The one dimensional, two dimensional, three dimensional, and RFID tags utilize the sensor 2024 mounted on the playing surface of the gaming table. The interactive cards 2010 are passed over the sensor 2024 and an indication signal which is either an audible beep, click, or indicator light, is activated for the dealer to ensure accuracy of the reading of the card.

Referring to FIG. 21, a sensory system 2100 is implemented to track the use of the interactive playing card 2010 as previously discussed during in one embodiment a playing card game within a casino. In this particular embodiment, a group of players 2110A—2110K are situated about a game table 2120. Correlated or placed in front of the individual players are playing card sensors 2114A—2114K. These sensors, which as previously discussed above, can be bar code sensors, or RFID sensors, which can be built into the game table, placed below the game table, placed above the game table, or situated around the edge of the game table. Also an additional embodiment would be to have the sensors as movable mats which are connected via WIFI or wireless local area network to the sensory relay hub 2124. In addition to the players, a dealer 2112 (who can also be a player 110), is situated at the game table 2120. The dealer utilizes a sensor which is a register sensor 2116 or a dealer sensor 2116. The dealer sensor 2116 is used by the dealer to register and/or scan new or old interactive playing card decks when used during game play.

During the course of the game, players may discard or fold certain interactive playing cards, and the dealer will pass these cards over a fold sensor 2118 which in this particular embodiment is placed on either side to the left or right of the dealer position 2112.

The dealer sensor 2116, the player sensors 2114A—2114K and the fold sensors 2118 are all connected, either wirelessly or via wire such as coaxial cable or the like to the server 2126 through the use of a sensor relay hub 2124. The dealer 2112 will run a client computer 2115 to initialize various game applications which will correlate with the interactive playing cards for example, the dealer may bring up a poker application on the client's computer 2115 which is initialized from the server 2126. The interactive playing cards 2010 from the interactive playing card deck which is initialized by the dealer sensor 2116, will interpret the suit card element 2016 and the face value card element 2018 maintained within the readable data component 2020 of the interactive playing card 2010 (FIG. 14), scanned by the various sensors, and correlate this information with the display software or application run by the card identification or card sensory application 2128.

As the game progresses, the readable data component 2020 information will be displayed in real time on various monitors and broadcast information or components 2132. Furthermore, affiliate software 2130 such as a parimutuel wagering application on large entrant groups, herein incorporated by reference as U.S. Patent Application Publication No. 2006/0252520 published Nov. 9, 2006, can monitor and display the game information which is occurring at the game table 2120 in real time enabling viewers to wager in parimutuel fashion on the entrants in the game.

Figure 23:
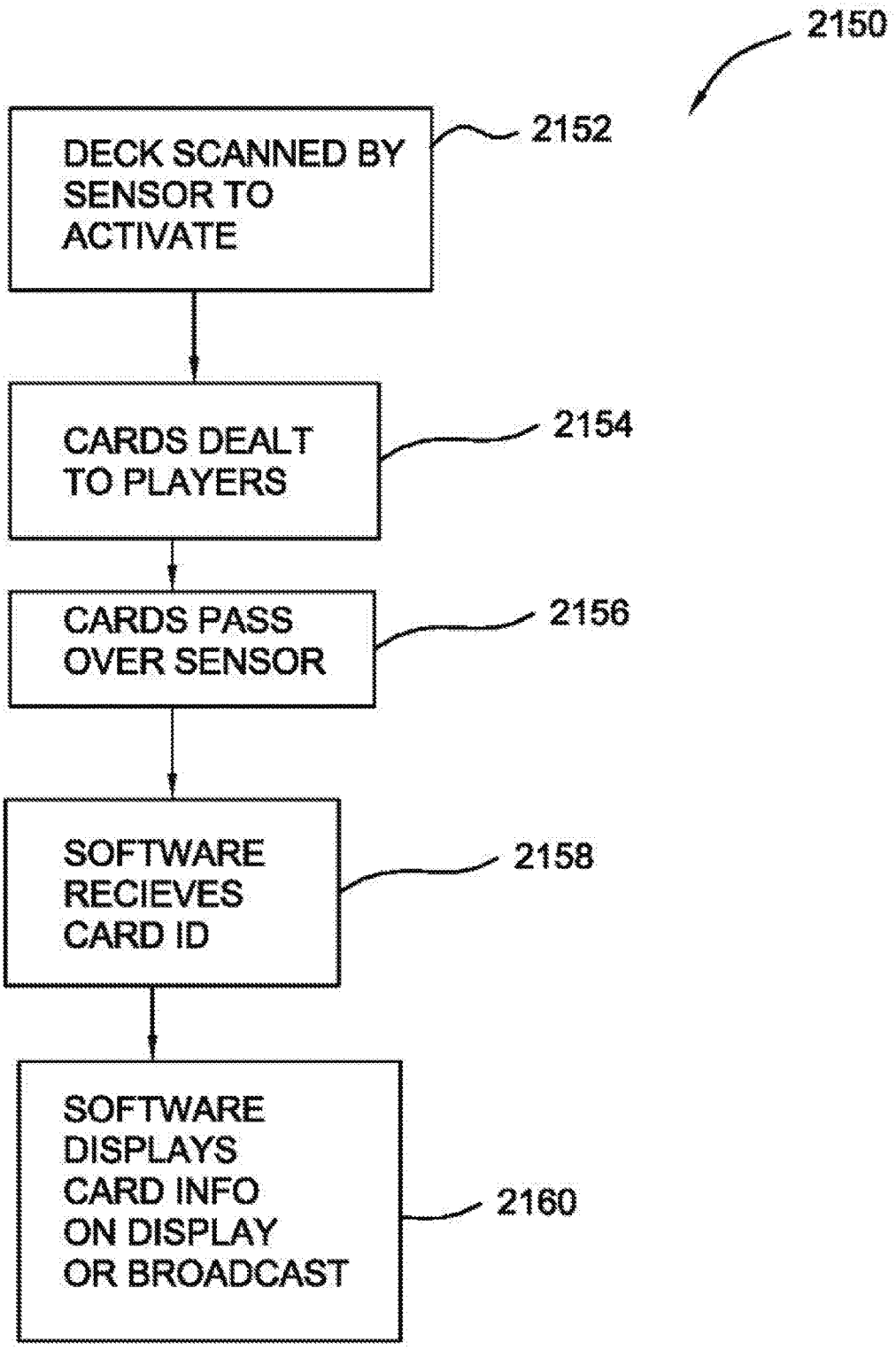
FIG. 23 is a flow chart to monitor interactive playing cards in a game.

Referring now to FIG. 23, a method to monitor the interactive playing card in a game will now be discussed. During game play or tournament play, the dealer at step 2152 scan the card deck with the dealer sensors 116 which registers the new deck with the card identification software or sensory application 2128 activating the deck for use in the game.

No matter what game, cards are generally dealt at step 2154 to the players by the dealer, the dealer either being a player or a designated house dealer. At step 2156, cards are dealt, passing over the player bar code or RFID sensors which register the interactive playing cards used by the players during the game which then can be displayed on the TVs and monitors or the viewing system components 2132.

In doing so, the software at step 2158 recognizes the individual interactive playing card readable data components 2020 as previously discussed in FIG. 4, and then at step 2160 the software sends the graphic signal to the display or broadcast.

Figure 24:
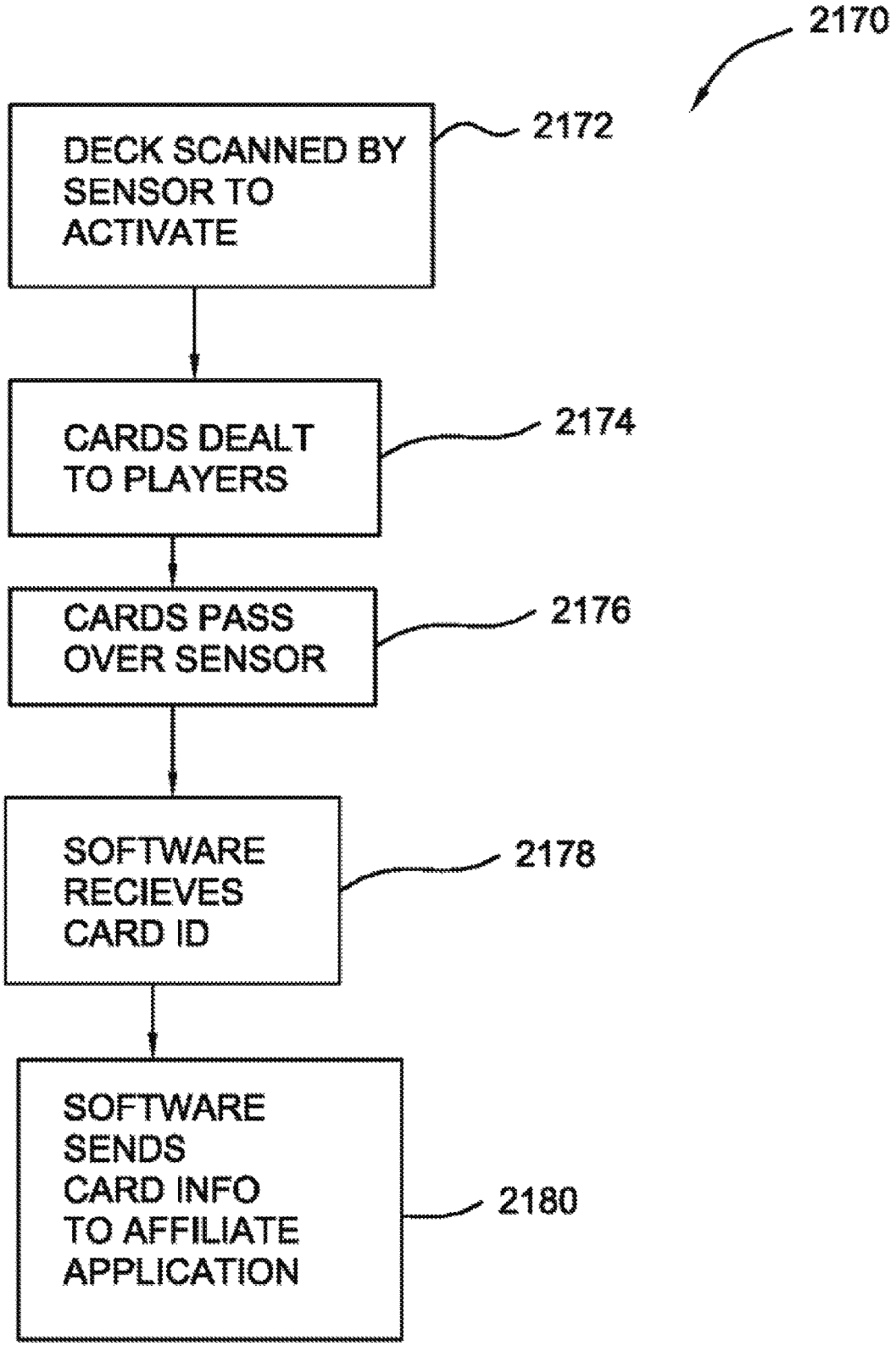
FIG. 24 is a flow chart to integrate the interactive playing cards with affiliate software.

During the scanning and monitoring of the decks and individual interactive playing cards, the sensors pass the digital information to the sensory application 2128 which is maintained on the server 2126 as previously seen in FIG. 21. Referring now to FIG. 24, a method for integration of interactive playing cards into the software application 2170 will now be provided.

The decks are scanned by the sensor at step 2172 and are activated as previously discussed in FIG. 23. Then at step 2174 again the cards are dealt to the players; at step 2176, the cards pass over the bar code or RFID sensor, the software at step 2178 recognizes the readable data component information and at step 2180 sends the readable data component information to affiliate software for display and/or use in additional applications including the previously mentioned parimutuel wager on large entrant groups in a tournament.

Figure 25:
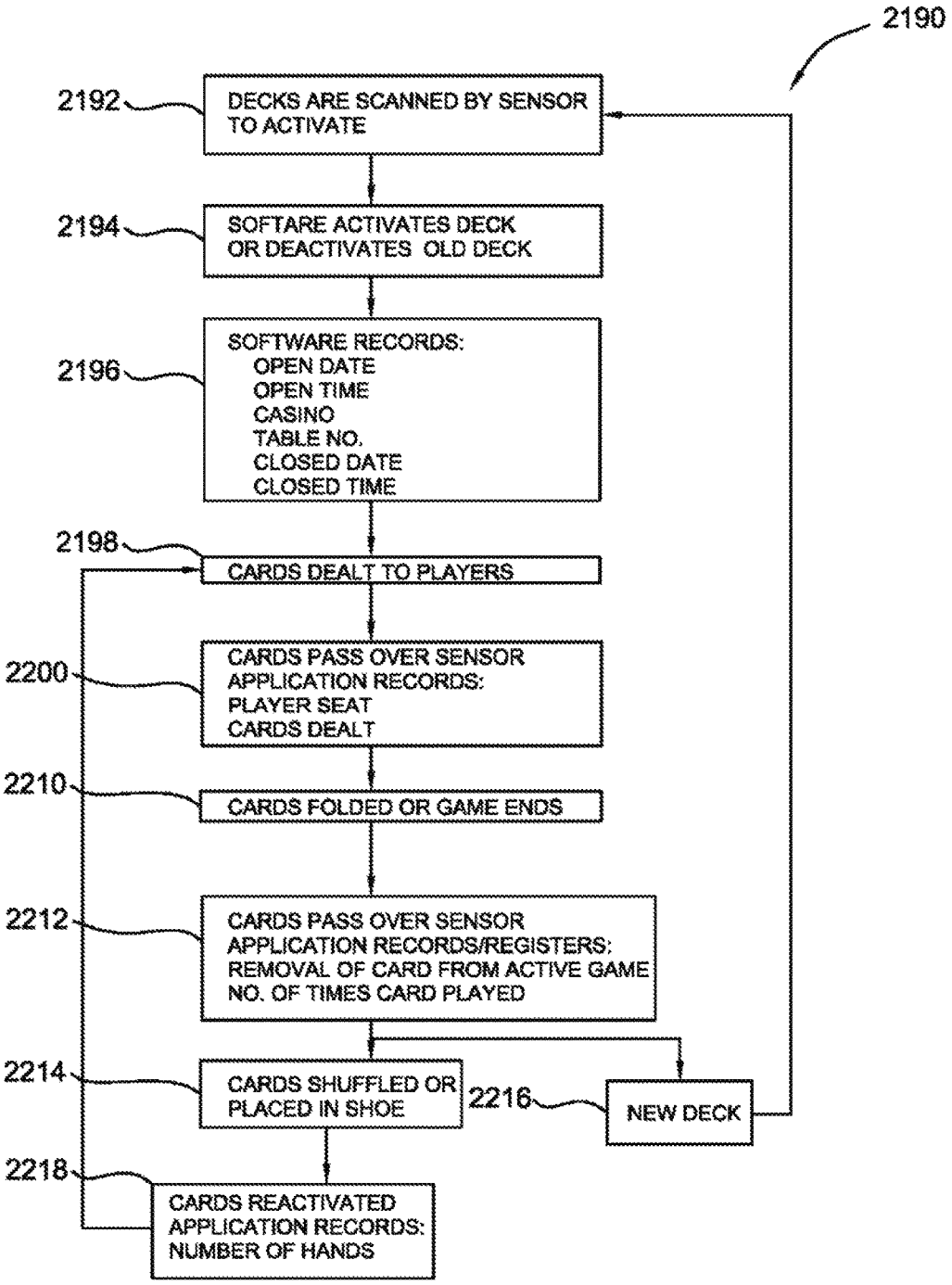
FIG. 25 is a flow chart to monitor the interactive playing cards for use in inventory.

While the interactive playing card can be monitored during the play of the game, the playing card can being monitored during the life cycle of the card and tracked through the card identification software or the sensory application 2128 through correlation with various databases and inventory applications 2134. Referring now to FIG. 25, discussion of a method to monitor interactive playing card inventory 2190 will now be provided. Even before the interactive playing card decks are delivered to the gaming location, the decks are manufactured and produced with the readable data component 2020 as seen in FIG. 14, which maintains the discreet data points correlating to the application inventory software 2134 which is usable through a distribution chain such as a UPC (uniform product code), or other bar code scan technologies. As the data points fill up within the inventory software 2134 which correlates to the particular item or serial code as previously discussed above, the information correlated with that code increases in value within the supply chain.

When the interactive playing card deck reaches the gaming area, the interactive play card deck is scanned by the sensor and activated at step 2192. The sensory application 2128 as seen in FIG. 21, or the card ID software, activates at step 2194 the deck or in the alternative deactivates the old deck. The sensory application 2128 at step 2196 records the date that the deck was opened, the time that the deck was opened, gaming location such as a casino at which the deck was opened, the table at which the deck was being used, the date at which the deck was closed out, as well as the time at which the deck was closed out. The dealer 2112 will provide some of the real-time information through the use of the client computer 2115 at the gaming table 2120 when interfacing with the card ID software 2128.

The dealer then deals the cards to the players at step 2198; the cards then pass over the sensor at step 2200 recording the player seat and the card dealt to the sensory application 2128. After the round is complete, the cards are folded or the game ends at step 2210.

Once the interactive cards are passed back to the dealer, the dealer at step 2212 will register the used cards over the bar code fold sensor 2118 (FIG. 21), and the sensory application 2128 records the removal of the interactive playing card from the active game, as well as the number of times the interactive playing card was used for inventory purposes.

The interactive playing cards at step 2214 are then shuffled back into the game play or placed into the shoe for reshuffling. The interactive playing cards are then reactivated at step 2218 for re-dealing, and at this point the number of hands the card has been played is recorded at the sensory application 2120. In the alternative, the dealer may decide to activate a new deck at step 216 which is then scanned by the sensor at step 2192 as previously discussed.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

What is claimed is:

1. A system for coordinating a wagering event said system comprising:

a virtual web server comprising an administration application, the administration application comprising a pool type component, comprising a win bet or a mandatory pay out;

a player odds component configured to calculate, update, and send to said casino application, odds on a player ID component correlated to a particular pool ID component;

a player odds object configured to maintain information from said player odds component in said server database;

a server database comprising an event object configured to maintain event information from a first event page, where said first event page further comprises an event component comprising an event ID component, an event name component, an event description component, an event location component, an event website component, said event category component, an event start date component, an event end date component, a betting start date component, a betting end date component, an event management component;

an event category object configured to maintain event category information from said event category page;

a first set of player objects configured to maintain player information from said first set of player elements;

a first pool object configured to maintain pool information from said first pool page;

a wager object configured to maintain wager information from said wager, said wager information comprising said wager amount;

a wager detail component comprising a wager identification component, a player identification component, and a sequence component; said wager detail component configured to record wager detail information into said server database, a wager detail object comprising a wager identification object configured to maintain information from said wager identification component in said server;

a player identification object configured to maintain information from said player identification component in said server database;

a sequence object configured to maintain sequence information from said sequence component in said server database;

said wager detail object configured to maintain said wager detail information from said wager detail component in said server database;

said administration application configured as executable code to generate a first event page utilizing an event category page; said first event page comprising a first set of player elements;

said administration application further configured as executable code to generate a first pool page for management of a first wager pool;

said administration application further configured as executable code to interoperate with a banking application and a casino application, said banking application located at a financial institution, said casino application located at a casino location;

said administration application further configured as executable code to send and receive a wager from said casino application, said wager on a player from said first set of player elements;

said administration application further configured as said executable code to coordinate a wager amount to said banking application and to credit said first pool with said wager amount in a wager ledger.

2. The system according to claim 1 wherein said event object further comprises:

an event ID object to maintain event ID information of said event ID component;

an event name object configured to maintain event name information from said event name component;

an event description object configured to maintain event description information from said event description component;

an event location object configured to maintain location information from said event location component.

3. The system according to claim 1 wherein said event object further comprises:

an event asset object configured to maintain website information of said event website component;

an event time object configured to maintain time information of said event time component, said event time object comprising an event start date object, an event end date object, a bet start date object, a bet end date object;

an event management object configured to maintain event information of said event management component.

4. The system according to claim 1 wherein said first pool page further comprises: a select event component, a get pools component, a pool title component, a bet type component, a pool type component, a commission component, a pick count component, a maximum wager component, a wager minimum component, a wager maximum component, a flat payout component, a pool status component, a gross total component, a paid-out component, a previous pool component, an update component, an edit pool component.

5. The system according to claim 4 wherein said first pool object further comprises:

a select event object configured to maintain event information of said select event component;

a get-pools object configured to maintain pool information of said get-pool component;

a pool title object configured to maintain pool information of said pool title component;

a bet type object configured to maintain bet type information of said bet type component.

6. The system according to claim 5 wherein said first pool object further comprises:

a pool type object configured to maintain pool type information of said pool type component;

a commission object configured to maintain commission information of said commission component;

a pick counts object configured to maintain pick information of said pick count component;

a maximum wagers object configured to maintain maximum wager information of said maximum wagers component.

7. The system according to claim 6 wherein said first pool object further comprises:

a wager minimum object, configured to maintain minimum wager information of said wager minimum component;

a wager maximum object, configured to maintain maximum wager information of said wager maximum component;

a flat payout object configured to maintain payout information of said flat payout component;

a gross total object configured to maintain total wager information of said gross total component.

8. The system according to claim 7 wherein said first pool object further comprises:

a paid out object configured to maintain paid information of said paid out component;

a previous pool object configured to maintain the prior pool information of said previous pool component;

an update object configured to update pool information of said update component;

and edit pool object configured to edit prior pool information in said edit pool component.

9. A method for coordinating a wagering event including a virtual web server having an administrative application and a server database, said method comprising:

creating an event in said server database utilizing said administration application hosted on said virtual web server, wherein said creating an event further comprises creating an event category in said administration application by accessing an event category page, entering an event category name, and recording said event category name in an event category object located in said server database, initiating an event page in said administration application; entering an event name in said event page; recording said event name into an event name object located in said server database, entering an event description in said event page; recording said event description into an event description object located in said server database, entering an event location in said event page; recording said event location into an event location object located in said server database, entering an event website into said event page; recording said event website into an event website object located in said server database, choosing an event category from said server database holding said event category object, entering an event start/end date and time into said event page; recording said event start/end date and time into an event start/end date and time objects in said server database, and entering a bet start/end date and time into said event page; recording said bet start/end date and time into a bet start/end date and time object located in said server database;

displaying said event in a casino application located at a casino location;

creating a first set of event players in said administration application from a player page; recording a first set of event players for said event into said server database;

creating a first pool in said administration application from a first pool page; recording said first pool in a first pool object in said server database;

wagering on said event by sending an open for wagering signal to said casino application from said server database; receiving a first set of wagers from said casino application to said administration application; recording said first set of wagers into said server database; sending a closed for wagering signal from said administration application to said casino application;

hosting a casino event at said casino location and sending from said server database to said casino application an event start signal; setting a pending status for said first pool and sending from said administration application to said casino application said pending status; posting results of said casino event from said casino application into said administration application; recording said results of said casino event into said server database; sending from said server database to said casino application an event end signal; setting a closed status for said first pool and sending from said administration application to said casino application said closed status;

posting an event results list by sending said event results list from said server database to said casino application;

updating said first set of wagers to a win status, a loss status and recording said win status, said loss status, in said server database;

sending said win status, said loss status, from said server database to said casino application.

10. The method according to claim 9 wherein said recording a first set of event players further comprises: receiving a casino list of said first set of event players from said casino application; entering said first set of event players into an event player page initialized from said administration application; recording said first set of event players into an event players object in said server database.

11. The method according to claim 10 wherein said creating a first pool further comprises: loading an event from said server database; loading an event from said casino application; recording into said server database a pool title, a bet type, a pool type, a commission, a pick count, a maximum number of wagers, a wagering minimum, a wagering maximum, a flat payout.

12. A system for coordinating a wagering event, said system comprising:

means for creating an event in a server database hosted on a virtual web server, where said means for creating an event further comprises means for creating an event category by utilizing means for accessing an event category page, entering an event category name, and recording said event category name in an event category object located in said server database, and means for initiating an event page; means for entering an event name in said event page; means for recording said event name into an event name object located in said server database;

means for displaying said event in a casino application located at a casino location;

means for recording a first set of event players for said event into said server database, where said means for recording a first set of event players further comprises means for receiving a casino list of said first set of event players from said casino application; means for entering said first set of event players into an event player page; means for recording said first set of event players into an event players object in said server database;

means for recording a first pool in a first pool object in said server database, where said means for creating a first pool further comprises means for loading an event from said server database; means for loading an event from said casino application; means for recording into said server database a pool title, a bet type, a pool type, a commission, a pick count, a maximum number of wagers, a wagering minimum, a wagering maximum, a flat payout;

means for wagering on said event by utilizing means for sending an open for wagering signal to said casino application from said server database; receiving a first set of wagers from said casino application and utilizing means for recording said first set of wagers into said server database; means for sending a closed for wagering signal to said casino application;

means for hosting a casino event at said casino location and means for sending from said server database to said casino application an event start signal; means for setting a pending status for said first pool and means for sending to said casino application said pending status; means for recording results of said casino event into said server database; means for sending from said server database to said casino application an event end signal; means for setting a closed status for said first pool and means for sending from said server database to said casino application said closed status;

means for posting an event results list by utilizing means for sending said event results list from said server database to said casino application;

means for updating said first set of wagers to a win status, a loss status and recording said win status, said loss status, in said server database;

means for sending said win status, said loss status, from said server database to said casino application.

13. The system according to claim 12 wherein said means for creating an event further comprises: means for entering an event description in said event page; means for recording said event description into an event description object located in said server database.

14. The system according to claim 12 wherein said means for creating an event further comprises: means for entering an event location in said event page; means for recording said event location into an event location object located in said server database.

15. The system according to claim 12 wherein said means for creating an event further comprises: means for entering an event website into said event page; means for recording said event website into an event website object located in said server database.

16. The system according to claim 12 wherein said means for creating an event further comprises: means for choosing an event category from said server database holding said event category object.

17. The system according to claim 12 wherein said means for creating an event further comprises: means for entering an event start/end date and time into said event page; means for recording said event start/end date and time into an event start/end date and time objects in said server database.

18. The system according to claim 12 wherein said creating an event further comprises: means for entering a bet start/end date and time into said event page; means for recording said bet start/end date and time into a bet start/end date and time object located in said server database.

* * * * *